US005851743A

United States Patent [19]

Akao

[11] Patent Number: 5,851,743

[45] Date of Patent: Dec. 22, 1998

[54] COLORED PACKAGING MATERIAL FOR PHOTOSENSITIVE MATERIAL, METHOD FOR PRODUCING SAME, AND PACKAGED PHOTOSENSITIVE MATERIAL

[75] Inventor: Mutsuo Akao, Minami-ashigara, Japan

[73] Assignee: Fuji Photo Film Co., LTD., Kanagawa-ken, Japan

[21] Appl. No.: 774,355

[22] Filed: Dec. 27, 1996

[30] Foreign Application Priority Data

Dec. 28, 1995 [JP] Japan ..... 7-353004

[51] Int. Cl.[6] ..... G03C 3/00

[52] U.S. Cl. ..... 430/501; 242/348.4; 242/538.4; 242/588.5; 206/578; 206/455; 428/913; 428/35.2; 396/6

[58] Field of Search ..... 242/348.4, 538.4, 242/588.5; 206/578, 455; 428/913, 35.2; 430/501; 396/6

[56] References Cited

U.S. PATENT DOCUMENTS 4,452,846 6/1984 Akao ..... 428/220
4,780,357 10/1988 Akao ..... 428/216
4,810,733 3/1989 Sakuma et al. ..... 523/206

FOREIGN PATENT DOCUMENTS 2-2700 B 1/1990 Japan ..... B32B 27/32
5-2218 B 1/1993 Japan ..... G03C 3/00
6-1355 B 1/1994 Japan ..... G03C 3/00

*Primary Examiner*—Mark F. Huff
*Attorney, Agent, or Firm*—Sughrue, Mion, Zinn, Macpeak & Seas, PLLC

[57] ABSTRACT

A colored packaging material for the photosensitive material having improved light-shielding properties and physical properties, providing a packaged photosensitive material. Colored pigment is kneaded with dispersing pigment for dissociating and dispersing the colored pigment for improving uniform dispersion of the colored pigment for providing a colored packaging material for the photosensitive material having improved light-shielding and physical properties. The colored pigment is further improved in uniform dispersion by coating the colored pigment and the dispersing pigment with a surface coating agent such as fatty acid metal salt. For producing the packaging material, a master batch method, may be used. The packaging material may be used to make a packaged photosensitive material, e.g., injection or inflation molded articles.

24 Claims, 13 Drawing Sheets

COLORED PACKAGING MATERIAL FOR PHOTOSENSITIVE MATERIAL, METHOD FOR PRODUCING SAME, AND PACKAGED PHOTOSENSITIVE MATERIAL

FIELD OF THE INVENTION

This invention relates to a packaging material for a photosensitive material, colored by addition of a colored pigment, such as a packaging film, light-shielding plush (or teremp) cloth or the like, and a packaged photosensitive material, that is a photographic film-spool assembly obtained on placing a photographic film around a photographic film spool and housed in this state within a photographic film patrone (cartridge).

RELATED ART

For packaging a variety of materials whose commercial quality and value are lost on exposure to light, such as a photosensitive material, a packaging material capable of completely interrupting light without affecting photographic properties, is under development. It is crucial to improve light-shielding performance of the packaging material by having colored materials contained therein. To this end, the following techniques have been proposed.

In JP Patent Kokoku JP-B-2-2700, there is disclosed a packaging film for a photosensitive material having at least one layer of a light-shielding film formed of a light-shielding material composed of a polyethylene-based polymer and not less than 1 wt % of a light-shielding material, with not less than 50 wt % of the total polyethylene-based polymer being linear low-density polyethylene, referred to hereinafter as L-LDPE. This provides a packaging material superior not only in light-shielding performance but also in moisture-proofness, physical strength and packaging processability etc. The light-shielding materials may be enumerated by carbon black, Cobalt Blue and mono- or poly-azo based pigments, as colored pigments, and by titanium dioxide, calcium carbonate and barium sulfate as white-colored pigments.

In JP Patent Kokoku JP-B-5-2218, there is disclosed a packaging film for a photosensitive material having a photographically inactive layer formed thereon by applying a surface coating liquid composed of a vinyl chloride based copolymer resin, vinyl amino resin, an alkyd vinyl-based resin, oil-free alkyd resin, thermo-setting acryl-amino resin, or high- or low-molecular polyester-amino resins. This technique provides a packaging material for a photosensitive material which does not produce photographically deleterious effects, such as fogging, on the photosensitive material. It is disclosed therein to use a coating agent comprised of specified synthetic resins containing a photographically inactive colored pigment (page 2 column 4 lines 5 to 9) or a printing ink containing carbon black (page 3 column 5 lines 29 and 30). It is also disclosed to apply an undercoating containing titanium white as a white pigment (page 3 column 5 lines 26 to 28).

In JP Patent Kokoku JP-B-6-1355, there is disclosed a packaging material for a photosensitive material containing at least one pigment selected from among pigments, Chrome Yellow, Chrome Vermillion, soluble azo-based pigments, quinacridone-based pigments isoindolinone-based pigments, and a Lake-Red 4R. This provides a packaging material containing the pigments not affecting photographic performance.

It has also been known to use high refractive index pigments for improving coloration properties of the pigments.

SUMMARY OF THE DISCLOSURE

However, according to the investigation toward the present invention, a certain problem has been encountered in the above enumerated techniques. It is frequently difficult to have the colored pigments uniformly dispersed in the packaging material for the photosensitive material desired to be colored. If the packaging material for the photosensitive material is colored in the poor dispersion state of the colored pigment, micro-grids are produced in the colored packaging material for the photosensitive material, occasionally producing through-holes to give rise to defects such as light fogging in the photosensitive material or insufficient adhesion caused by lowered moisture-proofness. The packaging material for the photosensitive material is poor in coloration properties due to poor dispersibility of the colored pigments, such that, for improving coloration properties, the colored pigments need to be added in increasing amounts. If the amount of the colored pigments is increased further, the physical properties of the packaging material for the photosensitive material are lowered. Moreover, if a high refractive index pigment is used for improving coloration properties, sufficient coloration (light-shielding performance) cannot be produced without difficulties because of the poor dispersibility of the pigments.

It is therefore an object of the present invention to provide a novel packaging material for the photosensitive material wherein coloration properties (light-shielding performance) or physical properties are improved without adversely affecting the photographic performance.

It is another object of the present invention to provide a novel method for producing a colored packaging material for the photosensitive material and a packaged photosensitive material employing the colored packaging material for the photosensitive material.

Further objects will become apparent in the entire disclosure.

Primary Aspect:

The present invention provides, in general, a colored packaging material for the photosensitive material in which dispersibility of the colored pigments, generally insoluble in solvents or the like, is improved for improving light-shielding properties or physical properties. The pigments of the present invention include both organic and inorganic pigments. The pigments are generally insoluble irrespective of whether the pigments are organic or inorganic. The pigments are required to be insoluble in this manner over a significantly broad range since the pigments need to be insoluble not only in the material to be colored but also in materials with which the pigments are likely to be contacted in future. Such insolubility in water, inorganic reagents, organic solvents, oils, plastics or plasticizers is a crucial property required of the pigments for preventing transcription or bleedout or preventing deleterious effects on the quality of the photosensitive material, such as photographic properties. The pigments are also liable to be aggregated and cannot be dispersed without difficulties. However, by kneading the colored pigment with a pigment dispersing the pigments (referred "dispersing pigments"), the particles of the colored pigments are dissociated and dispersed by the dispersing pigments for improving the dispersibility of the colored pigments in the colored packaging material for the photosensitive material without affecting the photographic properties of the photosensitive material. Specifically, the colored pigment tends to be dispersed in the aggregated state, such that, if it is attempted to have the pigment dispersed by a conventional method, it is difficult to destruct this aggregated state to produce uniform dispersion.

According to the present invention, since the aggregated state of the colored pigment is destructed by the dispersing pigment under the effect of shearing thus improving dispersibility of the colored pigment in the colored packaging material for the photosensitive material. Since the dispersibility of the colored pigment is improved in this manner, it becomes possible to improve the coloration density of the packaging material for the photosensitive material to produce a colored packaging material with improved light shielding properties. Moreover, since the dispersibility is improved, the concentration of the pigments may be lowered, so that it becomes possible to prevent micro-grids from being formed as well as to improve the physical properties of the colored packaging material for the photosensitive material.

One but primary aspect of the present invention is directed to a colored packaging material for the photosensitive material containing the colored pigment and the dispersing pigment.

Further aspects 2 to 4 relate to preferred embodiments. That is, aspect 2 is directed to a colored packaging material for the photosensitive material of aspect 1 wherein the Mohs' hardness of the dispersing pigment is not less than 1.5 times that of the colored pigment. That is, by using the dispersing pigment having a Mohs' hardness not less than 1.5 times that of the colored pigment, the soft colored pigment in the aggregated state is dissociated and dispersed thus facilitating dispersion of the colored pigment in the colored packaging material for the photosensitive material.

Aspect 3 is directed to a colored packaging material for a photosensitive material of aspect 1 or 2 wherein the surface of the colored pigment and/or the surface of the dispersing pigment is coated with a coating (or coating agent) comprising a fatty acid metal salt. By coating the pigment surface with such surface coating, coagulation of the pigment may be prohibited while hygroscopicity may be lowered to facilitate dispersion. In particular, the colored pigment liable to absorb the moisture, such as carbon black, may be lowered in hygroscopicity, thus preventing pinholes from being produced due to pore generation.

Aspect 4 is directed to a colored packaging material for a photosensitive material as defined in any one of aspects 1 to 3 wherein the fatty acid metal salt is a compound of a fatty acid having 6 to 50 carbon atoms and a metal selected from the group consisting of calcium, zinc, cobalt, manganese, tin, lead, aluminum, magnesium, sodium, barium and cadmium. The fatty acid comprises both saturated and unsaturated fatty acids.

According to further aspects, the present invention also provides a method for producing a colored packaging material for a photosensitive material and a packaged photosensitive material employing the colored packaging material for the photosensitive material. Namely, aspect 5 is directed to a method for producing a packaged photosensitive material in which the colored packaging material for the photosensitive material as defined in any one of aspects 1 to 4 which comprises kneading/mixing the colored pigment and the dispersing pigment with a resin for dissociating and dispersing the colored pigment into the resin. Aspect 6 is directed to a packaged photosensitive material in which the colored packaging material for the photosensitive material as defined in any one of aspects 1 to 4 is used for packaging the photosensitive material.

It would be selfexplanatory that the present invention provides a further aspect which is directed to a package using and/or comprising the colored packaging material of the various aspects.

In the present application, it is understood that the numeric range denotes an arbitrary numerical value comprised therein without being limited to both end values and denotes any arbitrary small-range values confined therein.

BRIEF DESCRIPTION OF THE DRAWINGS

FIG. 2(*b*) shows an embodiment of a colored packaging material for the photosensitive material formed by two-layer co-extruded films of a light-shielding thermoplastic resin film layer and a light-shielding resin film layer embodying the present invention.

FIG. 4(*b*) shows an embodiment of a colored packaging material for the photosensitive material made up of laminated light-shielding films obtained on bonding two light-shielding two-layer co-extruded films, as shown in FIG. 2(*b*), bonded together through a blocking B without interposition of an adhesive layer.

FIG. 8(*b*) is a cross-sectional view showing another container for a colored photographic film as a colored packaging material for the photosensitive material embodying the present invention.

Figure 1:
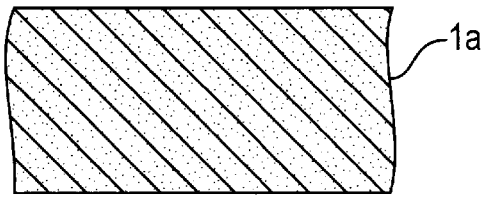
FIG. 1 shows an embodiment of a packaging material for a mono-layer photosensitive material formed only by a light-shielding thermoplastic resin film containing a light-shielding material etc. according to the present invention.

Explanation of Numerals a, . . . indicates the presence of the content of light-shielding materials etc.

EMBODIMENTS OF THE INVENTION

Basically, the present invention resides in kneading/mixing the colored pigments and the dispersed pigments for dissociating and dispersing the colored pigment for improving its dispersibility. Specifically, by kneading the colored pigment, insoluble in solvents or the like and liable to form an aggregate or agglomeration, with the dispersing pigment, the colored pigment particles are dissociated and dispersed by the dispersing pigment, thus improving dispersibility of the colored pigment in the packaging material for the photosensitive material without adversely affecting the photographic performance.

The "colored pigment" herein means a colorant pigment, colored in other than the white color, and not liable to become of a whitish color on mixing with a white colored pigment. The colored pigment may be of any type provided that it can afford light shielding properties to the packaging material for the photosensitive material. However, organic colored pigments, containing metals or impurities in lesser amounts as compared with inorganic pigments and superior in photographic performance and black pigments most capable of absorbing light and exhibiting significant light-shielding performance, are preferred. In particular, the black organic pigment exhibiting superior dispersibility and carbon black, less costly and exhibiting significant light-shielding performance, are more preferred.

The colored pigments of the present invention, which are most desirable in being less costly as colored pigments and superior in light-shielding performance without adversely affecting the photographic properties of the photosensitive material, may be enumerated by furnace carbon black, channel carbon black, thermal carbon black and acetylene carbon black, in terms of the classification by the producing methods for the carbon black. Of these, furnace carbon black is most preferred in exhibiting light shielding properties without exhibiting deleterious photographic properties, such as fogging, lowered sensitivity or increased light sensitivity. The characteristics of carbon black include a mean particle size as measured by an electronic microscope method of 5 to 350 mμ (nm), preferably 9 to 250 mμ, more preferably 13 to 150 mμ, and most preferably 15 to 70 mμ. The pH value, as measured by a method according to JIS K-6221, is 3 to 9.5, preferably 5 to 9, more preferably 5.5 to 8.5 and most preferably 6 to 8. The DBP oil absorption amount, as measured by the oil absorption method A of JIS K-6221, is 10 to 350 ml/100 g, preferably 20 to 250 ml/100 g, more preferably 30 to 200 ml/100 g, and most preferably 40 to 150 ml/100 g. If carbon black is of the particle size of 5 to 350 mμ, a pH value of 3 to 9.5 and of the DBP oil absorption amount of 10 to 350 ml/100 g, it exhibits good dispersibility into the packaging material for the photosensitive material on kneading with the dispersing pigment and affords excellent light shielding properties, physical properties and moldability to the colored packaging material for the photosensitive material without affecting its photographic performance. Examples of commercially available articles include carbon black #20(B), #30(B), #33(B), #40(B), #41(B), #44(B), #45(B), #50, #55, #100, #600, #950, #1000, #2200(B), #2400(B), MA8, MA11, MA100 and the like manufactured by MITSUBISHI KASEI KK. Examples of overseas products include Black Pearls 2, 46, 70, 71, 74, 80, 81, 607 etc.; Regal 300, 330, 400, 660, 991 and SRF-S and Sterling IO, SO, V, S, FT-FF and MT-FF etc. manufactured by CABBOT INC. Other examples include FW2 Beads, FW200 Beads, Printex U Beads, Printex 30 and 60 beads and Printex G Beads, manufactured by TEGSA INC. and Uniteel R, BB, 15, 102, 3001, 3004, 3006, 3007, 3008, 3009, 3011, 3012, XC-3016, XC-3017 and 3020, manufactured by ASHLAND CHEMICAL INC., without being limited thereto.

For avoiding deleterious effects on the photographic properties of the photosensitive material, the sulfur content in the carbon black, as measured by the method according to ASTM D-1619, is not more than 0.6 wt %, preferably not more than 0.3 wt % and more preferably not more than 0.1 wt %. The content of the cyan compounds, as measured by the 4-pyridine carboxylic acid-pyrazolone light absorption analysis, is not more than 0.01 wt %, preferably not more than 0.005 wt % and more preferably not more than 0.001 wt %. In addition, the content of aldehyde compounds, as measured by the iodine method, is not more than 0.1 wt %, preferably not more than 0.05 wt % and more preferably not more than 0.01 wt %. Utmost care should be exercised as to the amounts of these ingredients since these tend to affect the photographic performance of the photosensitive material even in minor amounts.

The amount of addition of the colored pigments, such as carbon black, is varied depending on the sorts or the thickness of the packaging material. For securing complete light shielding performance, moldability and physical strength, the amount of addition is generally 0.01 to 50 wt %, preferably 0.05 to 45 wt %, more preferably 0.08 to 40 wt %, and most preferably 0.1 to 35 wt %. If the amount of addition of the colored pigment, such as carbon black, is in a range of 0.01 to 50 wt %, the colored packaging material for the photosensitive material may be improved in physical strength, moldability and appearance. In the case of a thick-walled injection-molded article, such as patrone for photographic films, spools, film units with lenses or holders for photographic film sheets, the amount of addition of the colored pigments, such as carbon black, is 0.01 to 7 wt %, preferably 0.05 to 5 wt %, more preferably 0.08 to 3 wt % and most preferably 0.1 to 1.5 wt %.

The dispersing pigment is required to dissociate and disperse particles in the colored pigment, on being kneaded with the colored pigment, to improve dispersibility of the colored pigment in the packaging material for the photosensitive material. Specifically, the Mohs' hardness of the dispersing pigment is preferably not less than of a multiplication factor of not less than 1.5 times the Mohs' hardness of the colored pigment. The Mohs' hardness of the dispersing pigment is more preferably not less than 2 and most preferably not less than 3 times the Mohs' hardness of the colored pigment. With the Mohs' hardness of the dispersing pigment equal to 1.5 times that of the colored pigment, or higher, the dispersing pigment can be dissociated and dispersed into the colored pigment on kneading. If this factor of multiplication is less than 1.5, the effect of sufficiently dissociating and dispersing the colored pigment would tend to poor. By the Mohs' hardness is meant a method for classifying the hardness in ten stages of from 1 to 10 by using, as reference materials, talc, plaster, calcite, fluorite, apatite, orthoclase, quartz, topaz, corundum and diamond, having the hardnesses of 1 through to 10, respectively, and by scratching each of these reference materials against a material being tested by way of comparing the hardness. If the Mohs' hardness values of illustrative pigments are given only by way of examples, the Mohs' hardness value for kaolin and talc is 1.0, that for carbon black and calcium sulfate is 2.0, that for calcium carbonate and alumina is 3 to 3.5, that of dolomite is 3.8, that for lithopone pigment, zinc flower and magnecite (with magnesium oxide content of 30 to 60 wt %) is 4.5, that of silica is 5.0, that of enstatite (with magnesium content of 30 to 60 wt %) of 5.5, that for titanium dioxide and forsterite (with magnesium content of 30 to 60 wt %) is 6.0 and that for brown iron oxide is 6.5.

Illustrative examples of preferred dispersing pigments according to the present invention are given as shown below. The present invention, however, is not limited to these pigments. The white pigments may be enumerated by titanium dioxide ($TiO_2$, including both anatase and rutile types with a refractive index of 2.5 to 2.8), zinc sulfide (ZnS, with refractive index of 1.8), zinc flower (ZnO, refractive index of 2.0), barium sulfate ($BaSO_4$, refractive index of 1.64), white lead (PbO, refractive index of 2.1), lithopone pigment ($ZnS+BaSO_4$, refractive index of 1.8), alumina (refractive index of 1.7), magnesite (refractive index of 1.62), calcium carbonate ($CaCO_3$, refractive index of 1.6), talc (refractive index of 1.6), magnesium silicate (refractive index of 1.6), calcium sulfate ($CaSO_4$, refractive index of 1.6), dolomite (refractive index of 1.6), mica (refractive index of 1.5 to 1.6), aluminum hydroxide (refractive index of 1.5 to 1.6) and silica (refractive index of 1.45). Of these white pigments, dolomite, lithopone pigment, calcium carbonate, alumina and magnesite, having the Mohs' hardness of not less than 1.6 and the refractive index as measured with the oil immersion method of Larsen, are desirable in improving dispersibility of the colored pigment and light shielding properties. Zinc flower and titanium dioxide having the refractive index of not less than 2.0 are more preferred, while titanium dioxide having the refractive index of not less than 2.5 is most preferred. It is because the larger the refractive index, the more is the quantity of light scattered by the white pigments and the higher i-s the light-shielding capability. The mean particle size of titanium dioxide, as measured by the election microscope method, is 10 to 1500 mμ, preferably 40 to 1000 mμ, more preferably 100 to 600 mμ and most preferably 150 to 400 mμ. The dispersing pigment with the mean particle size of 10 to 1500 mμ is most preferred since the pigment is liable to affect the photographic performance of the photosensitive material to the least extent, inexpensive, less liable to be aggregated, more liable to disperse the colored pigment and is itself capable of scattering the visible light thereby improving the light shielding capability. On the other hand, calcium carbonate, barium sulfate and aluminum hydroxide are most desirable as the dispersing pigment since these are inexpensive, less liable to affect the photographic performance of the photosensitive material, and are most effective to improve fluidity of the packaging material for the photosensitive material to disperse the colored pigment.

Among the colored pigments, there are, for example, iron oxides such as black iron oxide ($Fe_3O_4$, black pigments) and brown iron oxide ($Fe_2O_3$, red pigment). Although the Mohs' hardness of black iron oxide is varied with the production method, it is on the order of 6.0, such that the pigment has a significant effect of dissociating and dispersing the colored pigment. Moreover, since the black iron oxide itself is the black pigment, it is desirable in increasing the coloring density of the colored pigment and the light-shielding performance. Brown iron oxide having the Mohs' hardness on the order of 6.5 depending on the production method, also has a significant effect in dissociating and dispersing the colored pigment.

In the case of an ink layer, a coating layer or a plastic film etc., with a thickness in the range of 0.1 to 200 μm, the content of the colored pigment in the colored packaging material for the photosensitive material is 0.1 to 50 wt %, preferably 0.3 to 45 wt %, more preferably 0.5 to 40 wt % and most preferably 0.8 to 35 wt %. The content of the dispersing pigment in the colored packaging material for the photosensitive material is 0.01 to 30 wt %, preferably 0.02 to 25 wt %, more preferably 0.05 to 20 wt % and most preferably 0.07 to 15 wt %. If the content of the colored pigment and that of the dispersing pigment in the colored packaging material for the photosensitive material are 0.1 to 50 wt % and 0.01 to 30 wt %, respectively, the colored pigment is improved in dispersibility while the colored packaging material for the photosensitive material is improved in physical properties.

Moreover, the content of the colored pigment in the colored packaging material for the photosensitive material is preferably not less than 1.5, more preferably 2 or more and most preferably 3 or 4 times the content of the dispersing pigment in the colored packaging material for the photosensitive material. If the content of the colored pigment in the colored packaging material for the photosensitive material is not less than 1.5 times the content of the dispersing pigment, it becomes possible to prevent the photosensitive material from being scratched or subjected to fogging due to abrasion by the dispersing pigment having the high Mohs' hardness and to prevent the color density of the colored pigment from being diluted with the dispersing pigment. On the other hand, if the content of the dispersing pigment in the colored packaging material for the photosensitive material is 0.01 to 30 wt %, preferably 0.02 to 25 wt %, more preferably 0.05 to 20 wt % and most preferably 0.07 to 15 wt %, the colored pigment can be dispersed effectively even if the content of the colored pigment is not less than 1.5 times the content of the dispersing pigment.

By kneading the colored pigment and the dispersing pigment together, the colored pigment can be improved in dispersibility, as explained previously. However, by using a surface coating agent containing a fatty acid metal salt, the colored pigment can be further improved in dispersibility. That is, the surface coating containing the fatty acid metal salt can coat the surface of the colored pigment and/or the dispersing pigment for preventing aggregation and for suppressing hygroscopicity of the pigment. In addition, if the surface coating agent containing the fatty acid metal salt is used, and the photosensitive material is a photographic photosensitive material which is the photosensitive material of the highest technical quality, there may be derived additional effects, such as prevention of fogging due to abrasion or pressure or of micro-grids responsible for scores, moisture absorption, generation of volatile substances deleterious to photographic performance or die lip contamination.

Useful as surface coating agents, other than fatty acid metal salts, encompass coupling agents such as azide silanes (disclosed in JP Patent Kokai JP-A-62-32125), silanes (such as aminosilanes) titanate-based coupling agents, and; surfactants, such as oxyethylene dodecylamines, compositions composed only of metal hydrate oxides (one or more of hydrate oxides of titanium, aluminum, cerium, zinc, iron, cobalt or silicon) and/or metal oxides (one or more of oxides of titanium, aluminum, cerium, zinc, iron, cobalt or silicon), cerium cations, selected acid anions, alumina, alkoxy titanium derivatives having α-hydroxy carboxylic acid residues as substituted group thereof, polytetrafluoroethylene, polydimethyl siloxane or silicon modified materials, phosphoric acid ester compounds, di- to tetrahydric alcohols, olefin wax, such as polyethylene wax or polypropylene wax, silica or zinc compounds (zinc chloride, zinc hydroxide, zinc oxide, zinc sulfate, zinc nitrate, zinc acetate or zinc citrate, alone or in combination), and polyhydroxy saturated hydrocarbons. However, surface coating materials containing fatty acid metal salts are most preferred in view of improving dispersibility of the colored pigments, photographic performance, moldability and physical properties of the colored packaging material for the photosensitive material.

The fatty acids making up the fatty acid metal salts are those having 6 to 50 and preferably 10 to 40 carbon atoms. The fatty acids may also be a mixture of various fatty acids having 6 to 50 carbon atoms. Examples of metals that make up the fatty acid metal salts may include one or more selected from among those : calcium, zinc, cobalt, manganese, tin, lead, aluminum, magnesium, sodium, barium and cadmium. The surface coating material containing the fatty acid metal salts is highly useful in improving dispersibility of the colored pigments, photographic performance and physical properties of the colored packaging material for the photosensitive material. The content of the fatty acid metal salt in the colored packaging material for the photosensitive material is 0.01 to 5 wt %, preferably 0.03 to 4 wt %, more preferably 0.05 to 3 wt % and most preferably 0.07 to 2 wt %. The content of the fatty acid metal salt in a range of 0.01 to 5 wt % is effective in improving dispersibility of the colored pigment and the physical properties of the colored packaging material for the photosensitive material without affecting the photographic performance of the photosensitive material. Among representative fatty acid metal salts, there are, for example, calcium stearate, zinc stearate, magnesium stearate, sodium stearate, calcium oleate, sodium palmitate, calcium laurate, calcium ricinoleate, zinc ricinoleate, zinc laurate, and 2-ethyl zinc hexonate. For applying a coating of the surface coating material containing the fatty acid metal salt, a coating material comprised of a kneaded mixture of the colored pigment and the dispersing pigment containing the fatty acid metal salt may be used. However, for improving photographic properties and dispersibility of the colored pigment, it is more effective to coating the colored pigment and coating the dispersing pigment individually and to knead the coated colored pigment and the coated dispersing pigment.

There is no particular limitation to the colored packaging material for the photosensitive material containing the colored pigment, the dispersing pigment and preferably the surface coating material containing the fatty acid metal salt (referred to hereinafter as the "light-shielding material"). Examples of the colored packaging material for the photosensitive material include packaging films obtained on heating and melting the resin, preferably synthetic resin, kneading the resin in the hot state with the light-shielding material and molding the resulting mixture. Examples of such packaging films include an inflation molded film, a T-die molded film product (such as a monolayer film, multi-layer co-extruded film, blocking laminated film), laminated film, injection molded products (such as film unit with a lens, magazine, patrone or cartridge for photographic film, light-shielding casing for a photographic film, photographic film spool, package for photographic film patrone, light-shielding casing or holder for photographic film), vacuum-molded products, vacuum press-molded products (discs for photographic film patrone), molded sheet products (package for web-like photosensitive materials) and extrusion laminated films. Other examples include a light-shielding plush (teremp) cloth, non-woven fabric, adhesive tape, label, light-shielding paper, barrier paper, insert paper, cassettes or small boxes and cardboard boxes. The component materials of the colored packaging material for the photosensitive material include paper, fiber, plastics, metal, pigments dyes and synthetic rubber, alone or in combination. A variety of inks or paints are used for coloration for affording light-shielding properties as well as for printing letters or character representation or designs or adhesives are used for bonding the various components together.

Among the packaged photosensitive materials employing the colored packaging material for the photosensitive material, there are a variety of photosensitive materials packaged within the interior of the above-mentioned colored packaging materials for the photosensitive material. Examples of the packaged photosensitive materials include a packaged photographic film, comprised of a photographic film placed around a photographic film spool and accommodated in this state in a patrone for photographic film, (patrone may be formed of metal, resin or paper), a packaged photographic film accommodated within a film unit having a lens, a packaged photographic film of a brownie type comprised of a photographic film and a light-shielding sheet wound around the photographic film spool, and a packaged roll-like or sheet-like photosensitive material enclosed within the interior of a light-shielding package (or bag).

There is no limitation to the sorts of the resin as a material for the packaging film which may be synthetic resin, natural reins or elastomer. Of these, synthetic resins are inexpensive and are most preferred. These resins may be thermoplastic or thermosetting resins. Examples of these resins include phenolic resins, urea resins, melamine resins, polyester resins, phthalic acid resins, silicon (silicone) resins, polyvinyl chloride resins, polyvinilydene chloride resins, polyvinyl acetate resins, polyvinyl alcohol resins, polyvinyl butyral resins, polyvinyl formal resins, polycapramide resins, polymethacrylate resins, polystyrene resins, polypropylene resins, polyethylene resins, acetyl cellulose rubber resins and petroleum resins etc. The polyethylene resins may be enumerated by branched high-pressure homopolyethylene resins having a melt flow rate (MFR) of 0.1 to 80 g/10 minutes and a density of 0.900 to 0.930 g/cm$^3$, a homopolyethylene resin having the MFR of 0.001 to 80 g/10 minutes and a density of 0.941 to 0.985 g/cm$^3$, a homopolyethylene resin produced by polymerization using a metal metallocene polymerization catalyst having a MFR of 0.1 to 80 in terms of g/10 min and a density of 0.900 to 0.930 g/cm$^3$ and having a molecular weight distribution in terms of Mw/Mn ratio (weight average molecular weight/number average molecular weight) of 1.5 to 15, and a homopolyethylene resin with a molecular weight distribution (Mw/Mn) of 1.5 to 15, obtained by polymerization using a metallocene polymerization catalyst with the MFR of 0.001 to 80 g/10 min and a density of 0.941 to 0.985 g/cm$^3$.

The resin as a material for the packaging film may also be a copolymer. Examples of this resin include an ethylene-$\alpha$ olefin copolymer resin (such as propylene-ethylene copolymer resin, ethylene-butene-1 copolymer resin, an ethylene-octene-1 copolymer resin, having an MFR of 0.1 to 20 g/10 min and a density of 0.870 to 0.945 g/cm$^3$, ethylene-hexene-1 copolymer resin or ethylene-4 methylpentene-1 copolymer resin), a propylene-butene copolymer resin, an ethylene-vinyl acetate copolymer resin, a styrene-butadiene copolymer resin, a styrene-propylene copolymer resin, a ethyrene-vinyl chloride copolymer resin, an ethylene-methyl methacrylate copolymer resin, an ethylene-methyl acrylate copolymer resin, ethylene-ethyl acrylate copolymer resin, styrene-acrylonitrile copolymer resin, an ethylene-acrylic acid copolymer resin, an ethylene-propylene-butene-1 ternary copolymer resin and an acrylonitrile-butadiene-styrene ternary copolymer resin etc. The thermoplastic resin may be crystalline or non-crystalline. As to the injection molded products in need of dimensional accuracy, such as a spool or a patrone or cartridge for a photographic film, a film unit with a lens, a non-crystalline resin and a crystalline resin having a molecular weight distribution of 1.5 to 7 and preferably 2 to 6, in particular, obtainable by polymerization using a metal metallocene polymerization catalyst.

The fiber may be synthetic, natural or regenerated fiber, while the paper may, for example, be a printing sheet (high-quality paper, medium-quality paper, high-grade common quality paper or common quality paper), paper for gravure printing, common printing paper, bond paper, art paper, coated paper and kraft paper.

In the following, the method for producing a colored packaging material for the photosensitive material according to the present invention will be explained. In producing a colored packaging material for the photosensitive material, the light-shielding material etc. and additives, such as anti-static agents, lubricants or stabilizers, need to be stabilized uniformly. For mixing the light-shielding material etc. or the resin, the resin etc. and the additives may be previously mixed together as conventionally and the resulting mixture may be then admixed with the light-shielding material. Alternatively, the additive and the light-shielding material etc. may be mixed simultaneously into the resin etc. In particular, fatty acid metal salts, colored pigments and the dispersing pigments may be preferably pre-mixed and needed together for dissociating and dispersing the colored pigment. In kneading the colored pigment and the dispersing pigment, any known type of kneader may be used. Examples of the kneaders include a mixing roll, a Σ-blade type kneader, Banbury mixer, a high-speed biaxial continuous mixer, an extruder type kneader (uniaxial screw type, a biaxial screw type or a multi-axial screw type) and a jet mill etc. From these types of the mixers, a suitable device may be selected taking into account the yield point of the system, viscosity or temperature conditions. In kneading the colored pigment and the dispersing pigment, a jet mill is most preferred. The operating conditions when using a jet mill include an external force of approximately 10 to $10^8$ dyne, preferably $5\times10$ to $5\times10^7$ dyne and more preferably $10^2$ to $10^7$ dyne and a processing time duration of approximately 0.1 to 500 min, preferably approximately 0.5 to 250 min and more preferably approximately 1 to 200 min, depending on the sorts and amounts of the colored pigment and the dispersing pigment. By setting the external force and the processing time duration to 10 to $10^8$ dyne and to 0.1 to 500 min, respectively, the colored pigment is kneaded with the dispersing pigment to destruct the state of aggregation of the colored pigment to cause uniform dispersion of the colored pigment.

Among the methods for mixing (/kneading) and dispersing the light-shielding materials etc. into the resins etc., there are following methods. The methods include a color compound method of coloring the light-shielding materials etc. to a pre-set density from the outset, a master batch method of mixing and dispersing the light-shielding materials etc. to a high density, such as to a density of 10 to 60 wt %, in an appropriate thermoplastic resin and diluting the resulting mass during molding to a pre-set density with similar or compatible (miscible) thermoplastic resin, a color paste method of coloring the resin etc. with the light-shielding material previously kneaded into a paste, and a liquid color method of dispersing the light-shielding material into a surfactant etc., only by way of non-limiting examples. Of these, the master batch method is preferred in view of prevention of micro-grids, facilitated handling operations, such as metering (weighing) or charging, prevention of pollution of working sites and cost. In JP Patents Kokoku JP-B-40-26196 and JP-B-43-10362, there are shown a method of mixing and dispersing a pre-kneaded light-shielding material etc. in a polymer dissolved in an organic solvent to produce a master batch of a polymer and the light shielding material and a method of mixing and dispersing the light-shielding material etc. in polyethylene etc. for producing a master batch, respectively.

Meanwhile, the mixing and dispersion may be performed under pre-set conditions using, for example, a high-speed agitator. Alternatively, the mixing and dispersion may be performed using, for example, the above-mentioned Banbury mixer (intensive mixer), a mixing roll, a Σ-blade kneader, a high-speed bi-axial continuous mixer, a uniaxial screw extruder type kneader, a multi-axial screw extruder type kneader, or a rotor-type extruder, under the above-given external force and the processing time conditions and at a temperature that may be set in a range of 70° to 400° C., preferably approximately 90° to 350° and more preferably approximately 110° to 300°, depending on resin types. The colored packaging material for the photosensitive material is molded as conventionally after mixing the light-shielding material etc. and the additive into the resin etc. For molding, a uni-axial screw type extruder or a bi-axial screw type extruder is used. In either case, the screw L/D is selected to not less than 15, preferably to 18 to 35, more preferably to 20 to 30 and most preferably to 22 to 28, for improving the dispersibility in the molding process.

Taking an example of a packaging film and a film unit with a lens, an illustrative colored packaging material for the photosensitive material containing the light-shielding material etc. and an illustrative packaged photosensitive material employing such packaging material, are explained. However, the present invention is not limited to these illustrative cases.

A colored packaging material for the photosensitive material shown in FIG. 1 is a film for colored packaging comprised of a light-shielding monolayer film made up only of a light-shielding thermoplastic film layer 1*a* containing the light-shielding material etc.

Figure 2A:
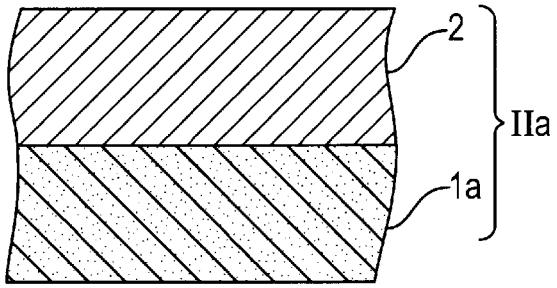
FIG. 2(*a*) shows an embodiment of a colored packaging material for the photosensitive material formed by two-layer co-extruded films of a light-shielding thermoplastic resin film layer and a thermoplastic resin film layer embodying the present invention.
Figure 2B:
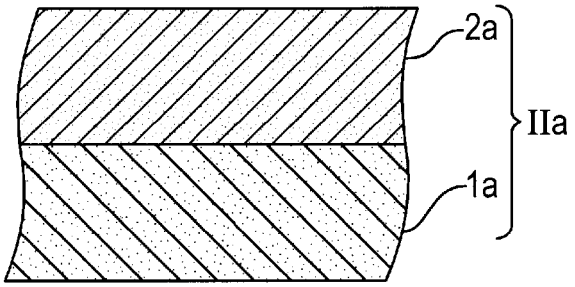

A colored packaging material for the photosensitive material shown in FIG. 2-(*a*) is a colored packaging film comprised of a two-layer co-extruded film IIa made up of a light-shielding thermoplastic resin film layer 1*a* and a thermoplastic resin film layer 2. FIG. 2-(*b*) shows a colored packaging film comprised of a two-layer co-extruded film IIa made up of a light-shielding resin film layer 1*a* and a light-shielding resin film layer 2*a* containing light-shielding material etc.

Figure 3:
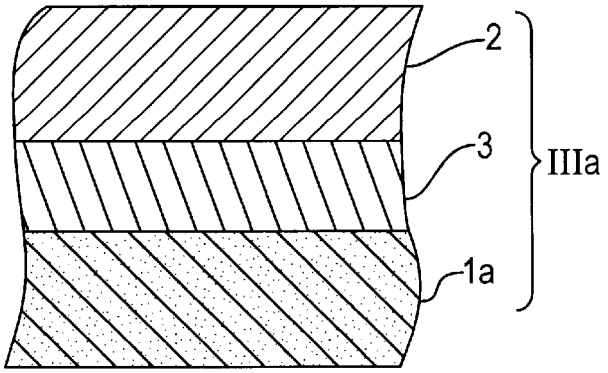
FIG. 3 shows an embodiment of a colored packaging material for the photosensitive material formed by three-layer co-extruded films of a light-shielding thermoplastic resin film layer, an intermediate layer and a thermoplastic resin film layer embodying the present invention.

A colored packaging material for the photosensitive material shown in FIG. 3 is a colored packaging film comprised of a three-layer co-extruded film IIIa made up of a light-shielding thermoplastic resin film layer 1*a*, an intermediate layer 3 and a thermoplastic resin film layer 2.

Figure 4A:
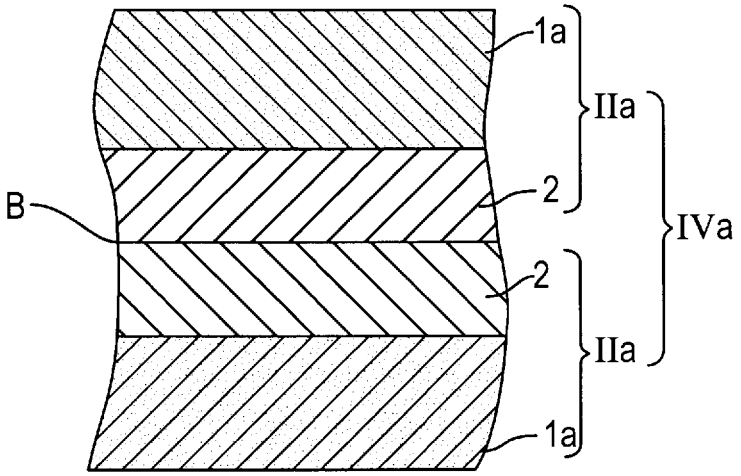
FIG. 4(*a*) shows an embodiment of a colored packaging material for the photosensitive material made up of laminated light-shielding films obtained on bonding two light-shielding two-layer co-extruded films, as shown in FIG. 2(*a*), bonded together through by a blocking B without interposition of an adhesive layer.
Figure 4B:
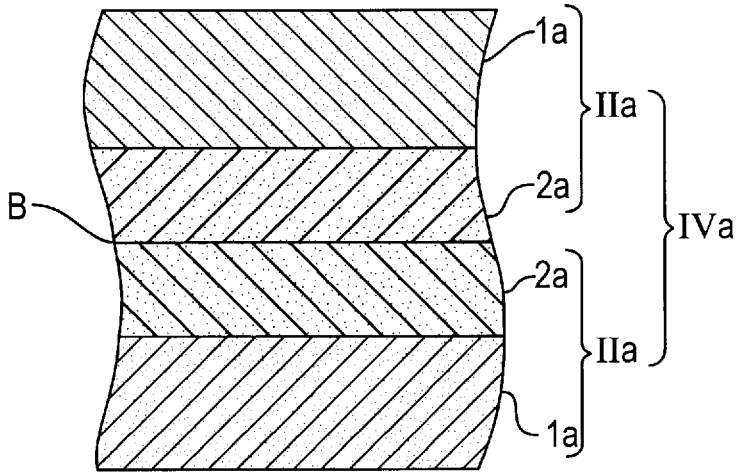

A colored packaging material for the photosensitive material shown in FIG. 4-(*a*) is a colored packaging film comprised of a light-shielding laminated film IVa made up of two light-shielding two-layer co-extruded films IIa in which the thermoplastic resin film layers 2 are bonded together through blocking B without interposition of an adhesive layer. FIG. 4-(*b*) shows a colored packaging film comprised of a light-shielding laminated film IVa made up of two light-shielding two-layer co-extruded films IIa in which the thermoplastic resin film layers 2*a* are bonded together through a blocking B without interposition of an adhesive layer.

Figure 5:
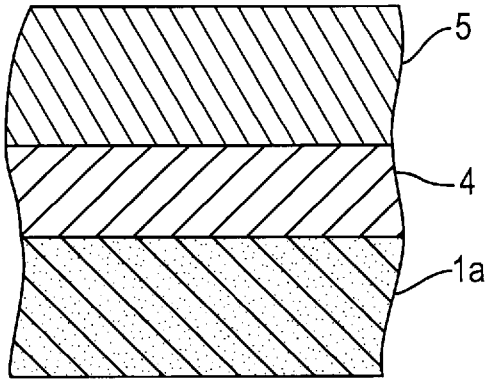
FIG. 5 shows an embodiment of a colored packaging material for the photosensitive material comprised of a laminated light-shielding film obtained on laminating a flexible sheet layer on a colored packaging material for the photosensitive material via a flexible sheet layer.

A colored packaging material for the photosensitive material shown in FIG. 5 is a colored packaging film comprised of a laminated light-shielding film made up of a light-shielding thermoplastic resin film layer 1*a* on which a flexible sheet layer 5 is laminated via an adhesive layer 4.

Figure 6:
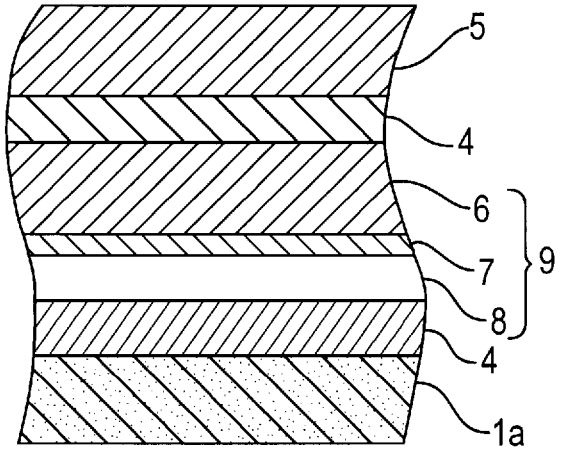
FIG. 6 shows an embodiment of a colored packaging material for the photosensitive material comprised of laminated light-shielding films obtained on laminating, via an anchor layer, a metal deposited bi-axial stretched film layer obtained on processing a vacuum-deposited metal layer and a flexible sheet layer on a light-shielding thermoplastic resin film layer and a bi-axially stretched film layer.

A colored packaging material for the photosensitive material shown in FIG. 6 is a colored packaging film comprised of a light-shielding thermoplastic resin film layer 1*a*, a metal deposited biaxial stretched film layer 9 and a flexible sheet layer 5 laminated together via an adhesive layer 4. The metal vaporized biaxial stretched film layer 9 is made up of a biaxially stretched film layer 6 anchored to a vacuum-deposited metal layer 8 via an anchor coating layer 7.

Figure 7:
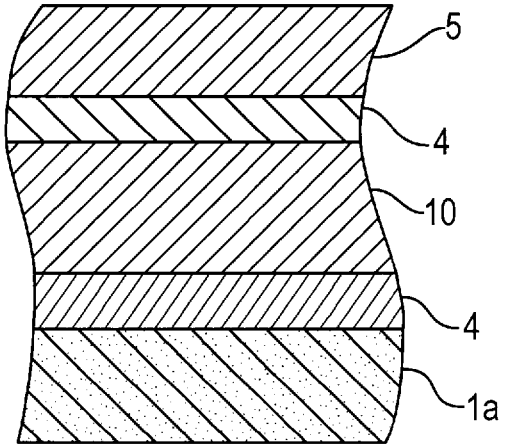
FIG. 7 shows an embodiment of a colored packaging material for the photosensitive material comprised of a light-shielding thermoplastic resin film layer, a metal sheet and a flexible sheet laminated together via adhesive layers.

The colored packaging material for the photosensitive material shown in FIG. 7 is a colored packaging film comprised of a light-shielding thermoplastic resin film layer 1*a*, a metal foil 10 and a flexible sheet layer 5, layered together via adhesive layers 4.

Figure 8A:
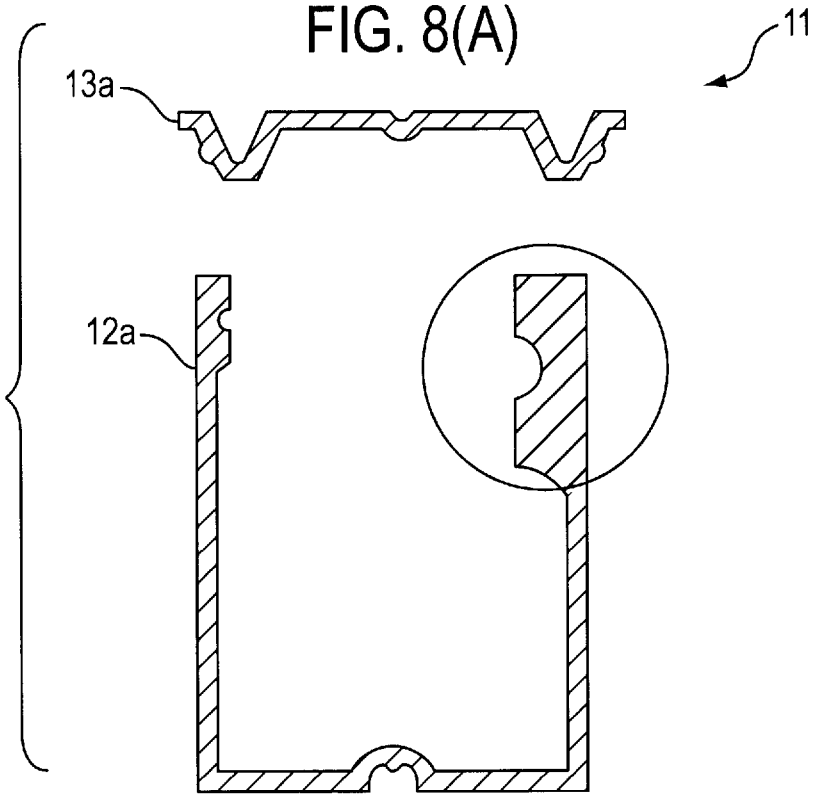
FIG. 8(*a*) is a cross-sectional view showing an embodiment of a container for a colored photographic film as a colored packaging material for the photosensitive material embodying the present invention.
Figure 8B:
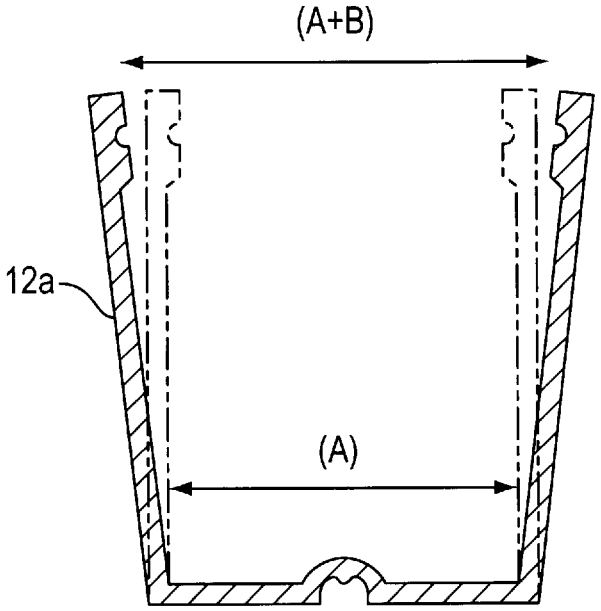

FIG. 8-(*a*) shows, in cross-section, a container (package) 11 for a colored photographic film patrone (cartridge) as a colored packaging material for the photosensitive material. The container 11 for the colored photographic film patrone is made up of a main member 12*a* (which may be substantially cylindrical or columnar with square or other rectangular cross section) of the container 11 for the colored photographic film patrone containing a light-shielding material etc. and a lid (cap) 13*a* for the container 11 for the colored photographic film patrone. The lid 13*a* has an engaging snap mechanism formed of an engaging circumferentially extending protrusion, formed on the outward wall of a V-shaped groove, adapted to engage a corresponding receiving groove disposed within the open end wall of the container 12*a*.

FIG. 8-(*b*) shows a main member 12*a* for the container 11 for the colored photographic film patrone constituting another container for a colored photographic film patrone as a colored packaging material for the photosensitive material. The main member 12*a* of the container 11 for the colored photographic film has a taper such that the inner diameter (A+b) of an upper opening is larger by b than the inner diameter of the bottom part. The value of b is set to 0.001 to 2 mm, preferably 0.01 to 1.5 mm, more preferably 0.02 to 1 mm and most preferably 0.05 to 0.5 mm.

Figure 9:
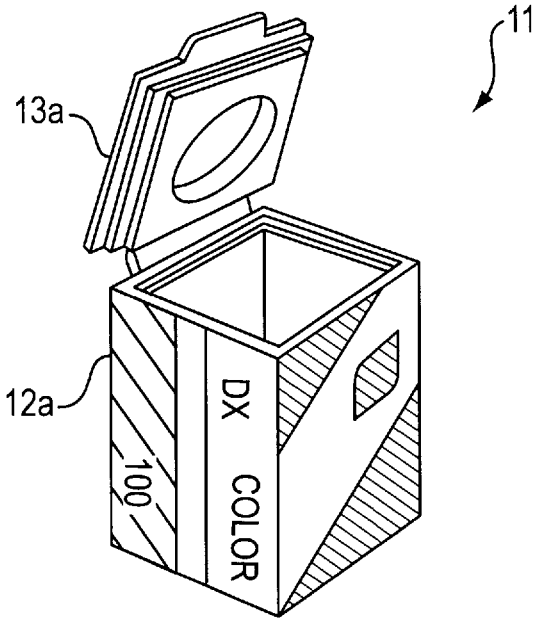
FIG. 9 is a perspective view showing a container for a colored photographic film patrone as a colored packaging material for the photosensitive material embodying the present invention.

FIG. 9 shows, in a perspective view, an embodiment of the container (case) 11 for a colored photographic film patrone as a colored packaging material for the photosensitive material. The container 11 for the colored photographic film patrone is made up of the main member (body) 12*a* of the container 11 for the colored photographic film patrone containing a light-shielding material etc. and the lid 13*a* for the container 11 for the colored photographic film patrone. The container has substantially a columnar shape with a square cross section, the lid 13*a* being connected to the main member 12*a* via a flexible point. The engaging snap mechanism is structured as shown in FIG. 8(*a*).

Figure 10:
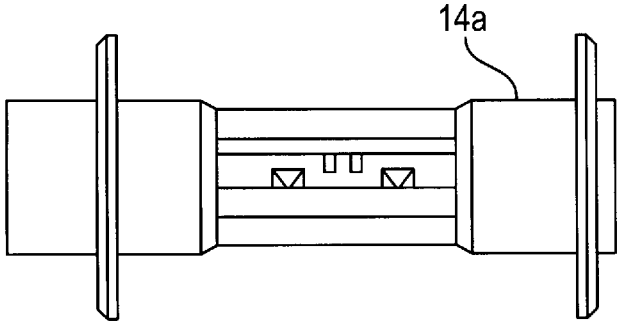
FIG. 10 is a front view showing a container for a colored photographic film patrone as a colored packaging material for the photosensitive material embodying the present invention.

FIG. 10 shows, in a front view, a spool 14*a*, for a light-shielding photographic film, containing a light-shielding material etc. as a colored packaging material for the photosensitive material.

Figure 11:
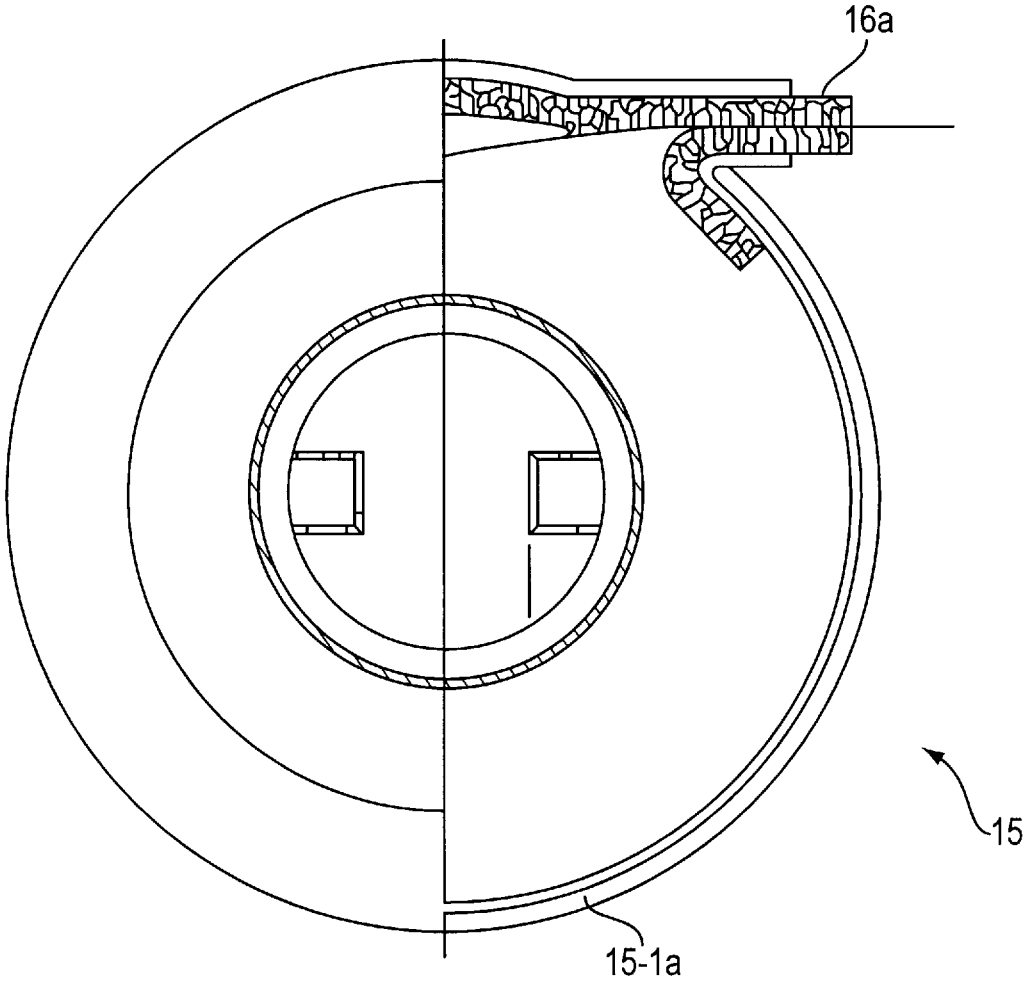
FIG. 11 is a schematic cross-sectional view showing a colored JIS 135 sized photographic film patrone as a colored packaging material for the photosensitive material embodying the present invention.

FIG. 11 shows, in a schematic cross-sectional view, a colored JIS135 sized patrone 15 for the photographic film as a colored packaging material for the photosensitive material. At an outlet opening (take out opening) for the photographic film of the colored JIS135 sized patrone 15 for the photographic film is provided with a light-shielding plush (teremp) cloth 16*a*. The light-shielding plush (teremp) cloth 16*a* is formed of synthetic fiber, such as light-shielding nylon 6,6 fiber or polyester fiber or rayon fiber, containing the light-shielding material. On the inside of a main member 15-l*a* of the light-shielding photographic film patrone, directed to the photographic film, is provided a printed layer containing a light-shielding material etc.

Figure 12:
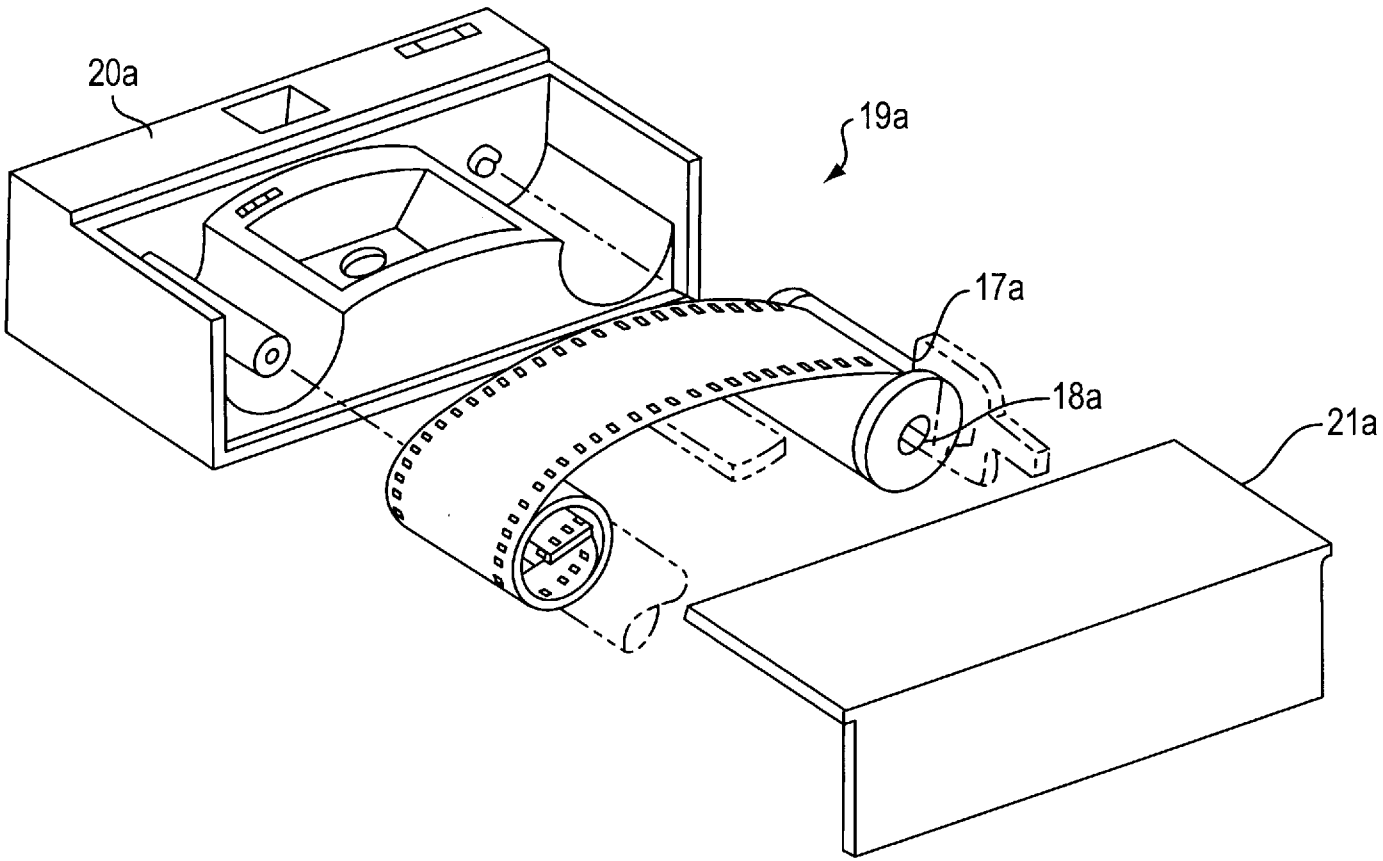
FIG. 12 is an exploded perspective view of a colored film unit having a lens as a colored packaging material for the photosensitive material embodying the present invention.

FIG. 12 shows, in an exploded perspective view, a colored film unit with a lens 19 as a packaged photosensitive material. This colored film unit with a lens 19 is made up of a light-shielding lower casing 20*a* and a light-shielding upper casing 21*a* for light-shielding tight sealing of the lower casing 20*a*. The light-shielding upper casing 20*a* is designed for accommodating a light-shielding patrone 17*a* for the photographic film in a light-tight fashion which is designed for accommodating a light-shielding spool 18*a* for the photographic film in a light-tight fashion. The casings 20*a* and 21*a* both contain light-shielding materials. In view of amenability to recycling, the light-shielding spool 18*a*, light-shielding upper casing 20*a* and the light-shielding lower casing 21*a* are preferably formed of the same or similar resin compositions.

Figure 13:
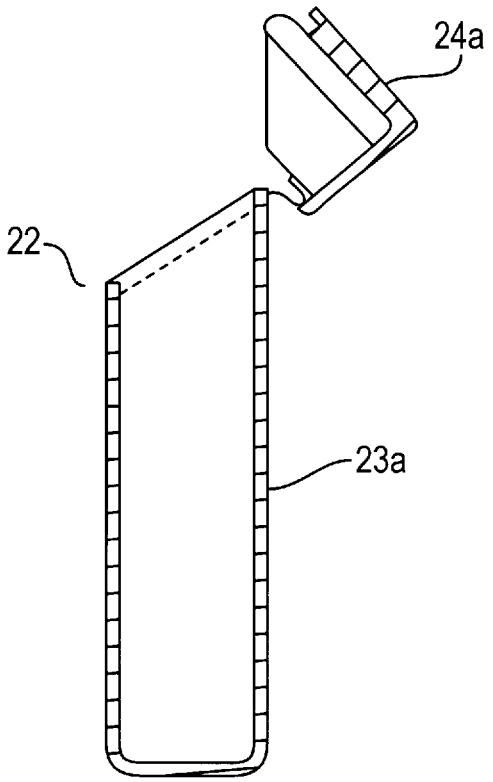
FIG. 13 is a cross-sectional view showing a light-shielding casing for a colored photographic film as a colored packaging material for the photosensitive material embodying the present invention.

FIG. 13 shows, in a cross-sectional view, a colored light-shielding casing 22 for a photographic film as a colored packaging material for the photosensitive material. The light-shielding casing 22 is formed unitarily by a main member 23*a* of the colored light-shielding casing for the photographic film and a lid 24*a* for the light-shielding casing for the photographic film, both the member 23*a* and the lid 24*a* containing the light-shielding material. A resilient thin connecting part is formed integral with both the members 23*a* and lid 24*a*.

Figure 14:
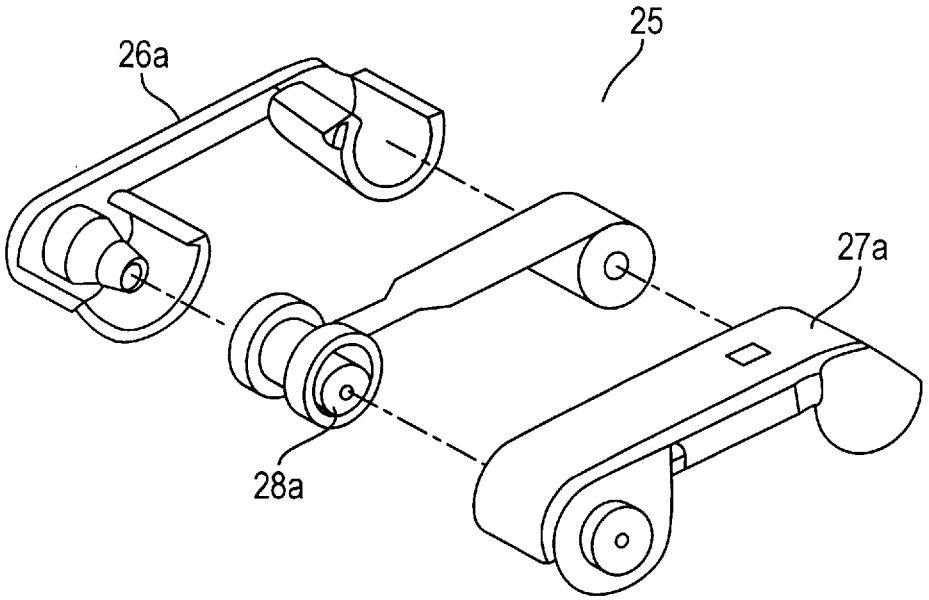
FIG. 14 is an exploded perspective view of a cartridge for a colored photographic film as a colored packaging material for the photosensitive material embodying the present invention.

FIG. 14 shows, in an exploded perspective view, a colored cartridge 25 for a photographic film as a colored packaging material for the photosensitive material. The colored cartridge 25 for a photographic film is made up of a light-shielding upper casing 26*a*, a light-shielding lower casing 27*b* and a light-shielding spool 28*a* around which are wound a photographic film and a light-shielding paper sheet loaded therein. These components all contain light-shielding materials. In view of amenability to recycling, the light-shielding spool 28*a*, light-shielding upper casing 26*a* and the light-shielding lower casing 27*a* are preferably formed of the same or similar resin compositions.

Figure 15:
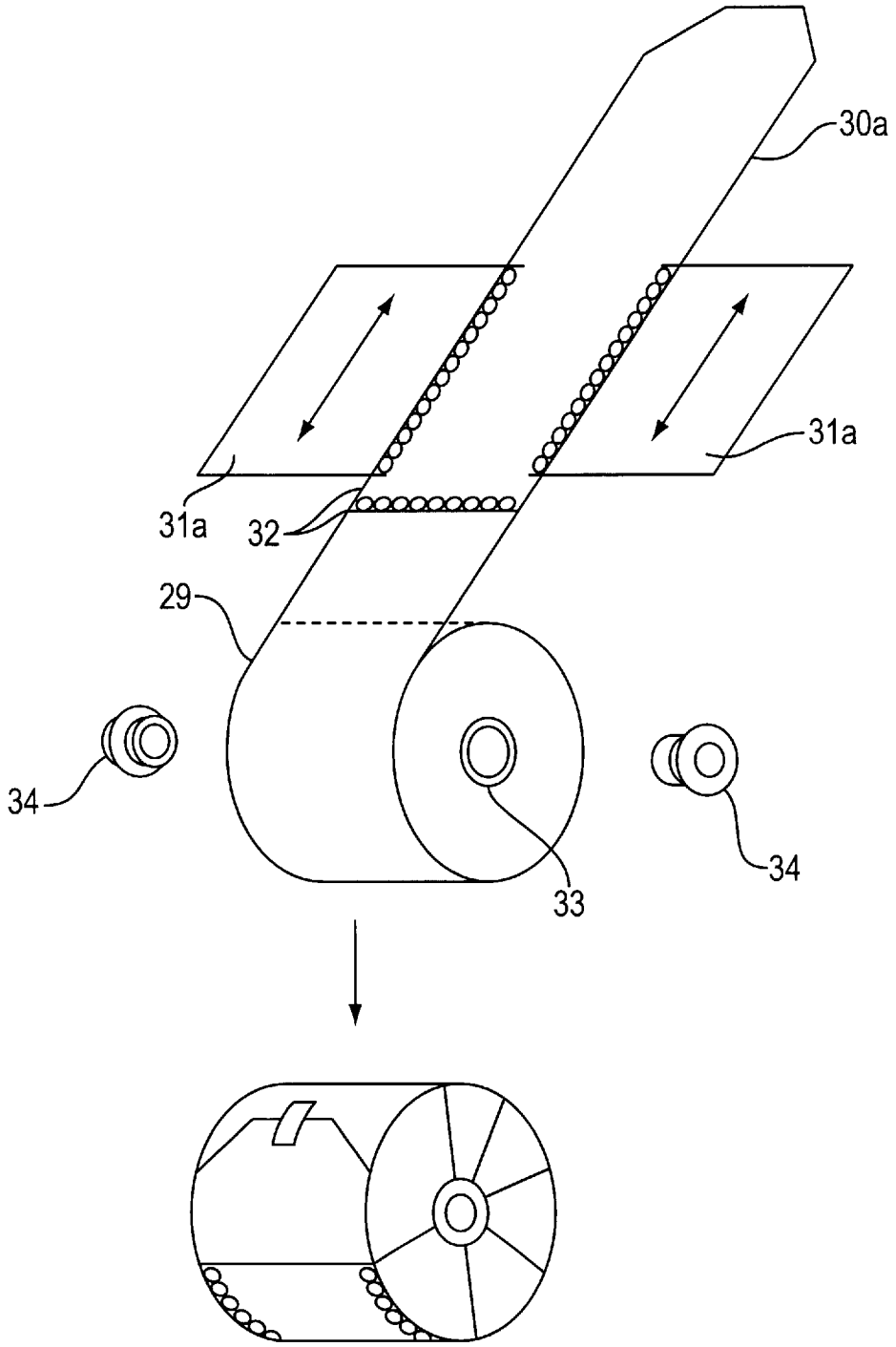
FIG. 15 is an exploded perspective view of a web-shaped packaged photosensitive material employing a light-shielding thermoplastic resin film layer as a colored packaging material for the photosensitive material embodying the present invention.

FIG. 15 shows an embodiment of a packaging (wrapping) process for a web-shaped packaged photosensitive material (or package thereof) employing a light-shielding thermoplastic resin film layer (wrapping sheet) as a colored packaging material for the photosensitive material. In this figure, numerals 29, 30*a* and 31*a* denote a web-shaped photosensitive material to be packaged, a film guide member for a light-shielding thermoplastic resin film as a colored packaging material for the photosensitive material and a film cover member for a light-shielding thermoplastic resin film as a colored packaging material for the photosensitive material, these members all containing the light-shielding material etc. The numeral 32 denotes a connecting part employing heat seals, an adhesive or an adhesive tape, while 33 and 34 denote a winding core and a bush (or plug) for tight sealing and packaging, respectively.

Figure 16:
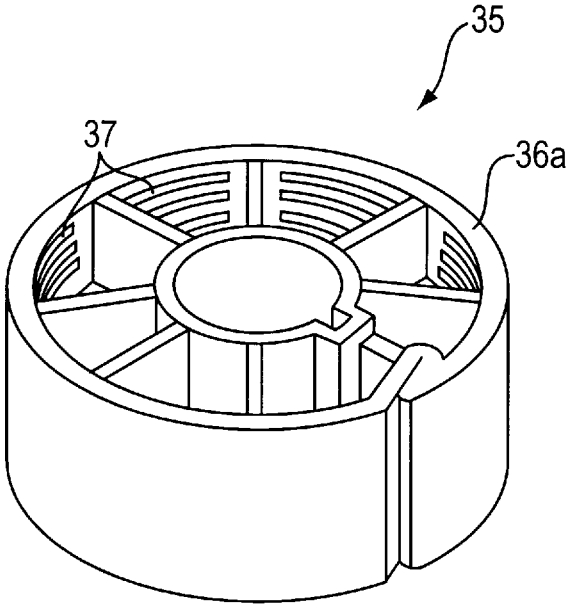
FIG. 16 is a perspective view showing a portion opposite to a resin injection opening of a core for the colored web-shaped photosensitive material as a colored packaging material for the photosensitive material embodying the present invention.

FIG. 16 shows, in a perspective view, a portion of a core 35 for the colored web-shaped photosensitive material as the colored packaging material for the photosensitive material lying opposite to a resin inlet opening for injection. The core 35 for the colored web-shaped photosensitive material is an injection-molded product. The core 35 has a light-shielding outer cylinder 36*a* containing the light-shielding material etc. On the inner surface of the cylinder 36*a* are formed plural annular ribs 37, each 0.0001 to 0.07 mm in height, for improving the injection molodability, physical strength and appearance of the core 35.

Figure 17:
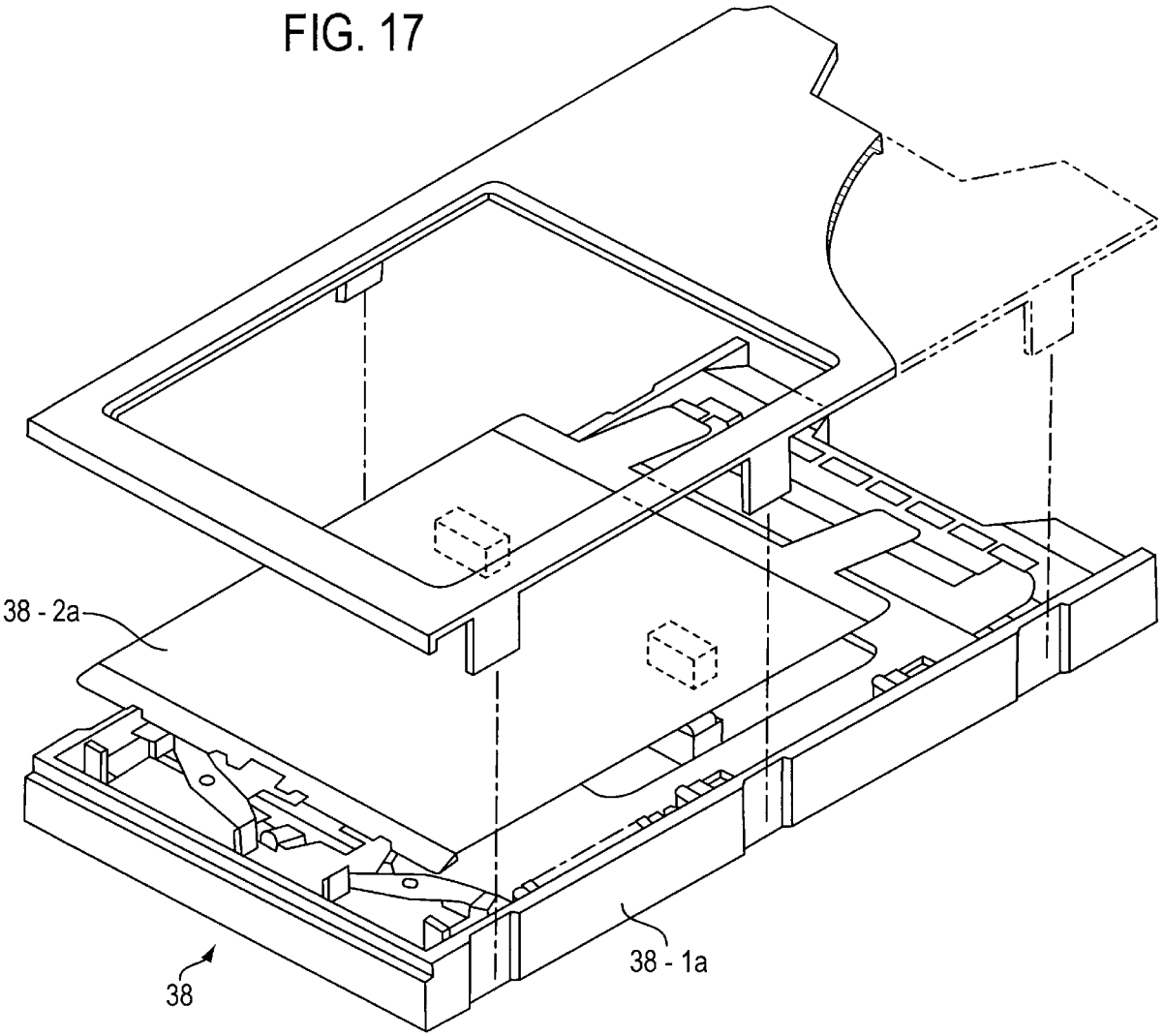
FIG. 17 is a perspective of a holder for a sheet-like photographic film packed in a light-shielding bag as a colored packaging material for the photosensitive material embodying the present invention.

FIG. 17 shows, in a perspective view, a holder 38 for a sheet-like photographic film enclosed in a light-shielding bag (envelop) as a colored packaging material for the photosensitive material, the holder being an injection molded product containing a light-shielding material etc. The holder has a main member 38-1*a* of the holder for the photosensitive material containing a light-shielding material etc. which is loaded on the back side of a camera so that a sheet-like photographic film 38-2*a* enclosed in the light-shielding bag may be introduced into or ejected from the main member 38-1*a*.

Figure 18:
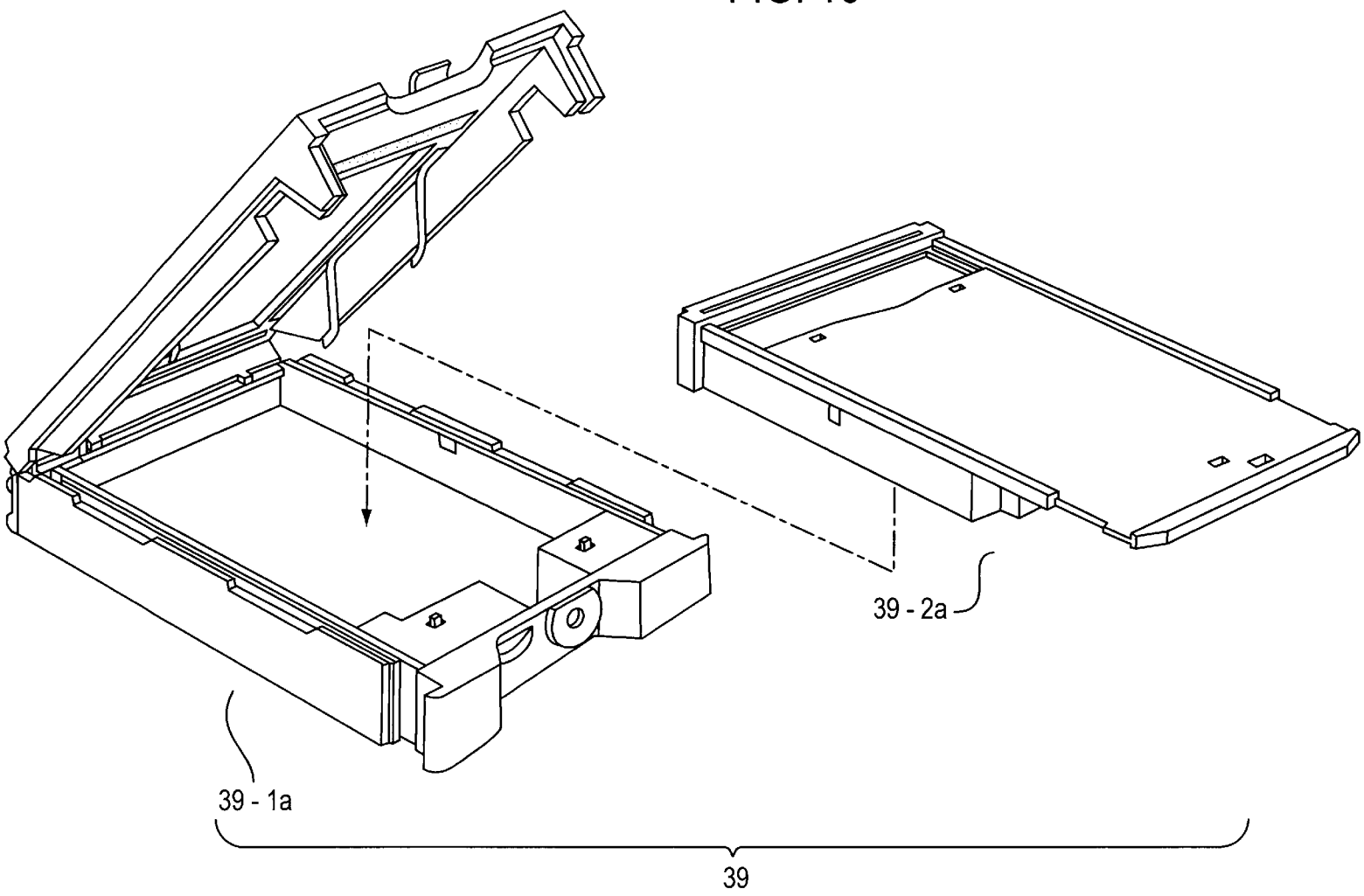
FIG. 18 is a perspective of a holder for a sheet-like photographic film packed in a light-shielding pack as a colored packaging material for the photosensitive material embodying the present invention.

FIG. 18 shows, in a perspective view, a holder 39 for a sheet-like photographic film enclosed in a light-shielding pack 39-2*a* as a colored packaging material for the photosensitive material, the holder being an injection molded product containing a light-shielding material etc. The holder has a main member 39-1*a* of the holder for the photosensitive material containing a light-shielding material etc. which is loaded on the back side of a camera so that a sheet-like photographic film pack 39-2*a* will be introduced into or ejected from the main member 39-l*a*.

Figure 19:
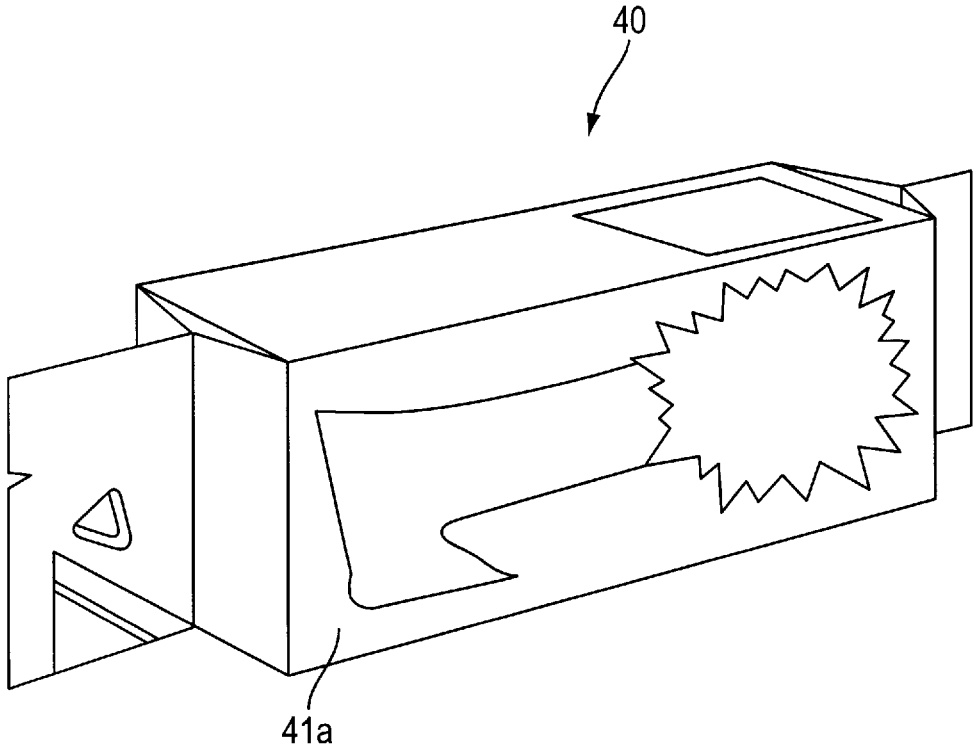
FIG. 19 is a perspective view of a packaged colored film unit having a lens as a packaged photosensitive material embodying the present invention.

FIG. 19 shows, in a perspective view, a packaged film unit 40 with a lens, as a packaged photosensitive material (or a package unit containing a photosensitive material). The packaged film unit 40 with a lens is produced by containing a colored film unit with a lens 19 shown in FIG. 12 in a hermetically sealed state in a colored packaging material for a photosensitive material employing a moisture-proofed packaging material. The colored packaging material for the photosensitive material is a light-shielding packaging bag (enclosure) 41*a* formed of laminated thermoplastic resin film layers containing a light-shielding material etc. Thus the light-shielding packaging is secured in dual ways directly and further indirectly with wrapping in the light-shielding packaging bag.

If necessary, any of a variety of lubricants may be used for the colored packaging material for the photosensitive material. Examples of most preferred lubricants include fatty acid amide-based lubricants and silicone-based lubricants which not only do not affect the photosensitive material (do not produce blocking or flaws between or within molded products even under insufficient recrystallization immediately after molding) but also are excellent in mold release properties or lubricity, do not attack metal molds and are inexpensive and readily available. The lubricants may be exemplified by erucic amides, oleic amides and ethylenebis stearic amides. Typical of the marketed lubricants are various grades of dimethyl polysiloxane and modified products thereof, such as "SHIN-ETSU SILICONE" or "TORAY SILICONE". Examples of oleic amide-based lubricants include "ARMOSLIP CP" (LION AKZO), "NEWTRON E-18" (NIPPON SEIKA), "AMIDE O" (NITTOH KAGAKU), "ARUFLOW E-10" (NIPPON YUSHI), "DIAMID 0-200" (NIPPON KASEI) and "DIAMID G-200" (NIPPON KASEI). An example of erucic amide lubricant is "ARUFLOW-P-10" (NIPPON YUSHI). Examples of stearic amide-based lubricants include "ARFLOW-S-10" (NIPPON YUSHI), "NEWTRON 2" (NIPPON SEIKA) and "DIAMID 200" (NIPPON KASEI). Examples of bis fatty acid amide-based lubricants include "BISAMIDE" (NIPPON KASEI), "DIAMID 200 bis" (NIPPON KASEI) and "ARMOWAX EBS" (LION AKZO).

The content of the lubricant in the colored packaging material for the photosensitive material is 0.001 to 5 wt %, preferably 0.005 to 4 wt %, more preferably 0.01 to 3 wt %, and most preferably 0.02 to 2 wt %. If the lubricant content is in the range of 0.001 to 5 wt %, it becomes possible to adjust fluidity, lubricity, mold release properties and friction of the resin during molding of the colored packaging material for the photosensitive material effectively.

In addition, anti-oxidants may also be added for preventing thermal deterioration, fish-eyes or micro-grids (agglomerated non-uniform defects) of the colored packaging material for the photosensitive material and for preventing generation of substances which might affect photographic properties of the photosensitive materials, such as aldehydes or halogenides. Illustrative examples of the anti-oxidants are given below. While the following anti-oxidants may be used alone or in combination, the anti-oxidants given below do not limit the present invention. Examples of phenolic anti-oxidants include 6-t-butyl-3-methylphenyl derivatives, 2.6-di-t-butyl-p-cresol, 2.6-t-butyl-4-ethyl phenol, 2.2'-methylene bis-(4-ethyl-6-t-butyl phenol), 4.4'-butylidene bis(6-t-butyl-m-cresol), 4.4'-thiobis(6-t-butyl-m-cresol), 4.4'-dihydroxy diphenyl cyclohexane, alkylated bisphenol, styrenated phenol, 2.6-di-t-butyl-4-methyl phenol, n-octadecyl-3-(3'.5'-di-t-butyl-4'-hydroxy phenol) propionate, 2.2'-methylene bis(4-methyl-6-t-butyl phenol), 4.4'-thiobis(3-methyl-6-t-butyl phenyl), 4.4'-butylidene bis (3-methyl-6-t-butyl phenoyl), stearyl-β(3.5-di-t-butyl-4-hydroxy phenyl) propionate, 1.1.3-tris(2-methyl-4-hydroxy-5-t-butyl phenyl) butane, 1.3.5 trimethyl-2.4.6-tris(3.5-di-t-butyl-4hydroxy benzyl) benzene and tetrakis [methylene-3 (3'.5'-di-t-butyl-4-hydroxy phenyl) propionate] methane. Examples of ketone amine condensation based anti-oxidants include 6-ethoxy-2.2.4-trimethyl-1.2-dihydroquinoline and 2.2.4-trimethyl-1.2-dihydroquinoline polymers and trimethyl dihydroquinone derivatives. Examples of allylamine based antioxidants include phenyl-α-naphthyl amine, N-phenyl-β-naphthylamine, N-phenyl-N'-isopropyl-p-phenylene diamine, N.N'-diphenyl-p-phenylene diamine, N.N'-di-β-naphthyl-p-phenylene diamine, N-(3'-hydroxy butylidene)-1-naphthylamine. Examples of imidazole based antioxidants include 2-mercapto benzoimidazole, zinc salts of 2-mercapto benzoimidazole and 2-mercapto methyl benzoimidazole. Examples of phosphite-based antioxidants include alkylated allyl phosphite, diphenyl isodecyl phosphite, tris(nonyl phenyl) phosphite sodium phosphite, trinonyl phenyl phosphite, triphenyl phosphite and tris-(2, 4-di-t-butyl phenyl) phosphite. Examples of thiourea based antioxidants include thiourea derivatives, 1.3-bis(dimethyl aminopropyl)-2-thiourea. An example of an antioxidant effective against air oxidation is dilauryl thiodipropionate. Examples of hindered phenol based antioxidants include 1,3,5-trimethyl 2,4,6-tris (3,5-di-tert-butyl-4-hydroxy benzyl) benzene, tetrakis [methylene-3-(3'. 5'-di-tert-butyl-4'-hydroxy phenyl) propionate] methane, octadecyl-3,5-di-tert-butyl-4-hydroxy-hydrocinnamate, 2,2',2'-tris[(3,5-di-tert-butyl-4-hydroxy phenyl) propionyloxy] ethyl isocyanurate, 1,3,5-tris (4-tert-butyl-3-hydroxy-2,6-dimethyl benzyl] isocyanurate, tetrakis (2,4-di-tert-butyl phenyl)4,4'-biphenylene diphosphite ester, 4,4'-thiobis-(6-tert-butyl-o-cresol), 2,2'-thiobis-(6-tert-butyl-4-methyl phenol), tris-(2-methyl-4-hydroxy-5-tert-butyl phenyl) butane, 2,2'-methylene-bis-(4-methyl-6-tert-butyl phenol), 4,4'-methylene-bis-(2,6-di-tert-butyl phenol), 4,4'-butylidene bis-(3-methyl-6-tert-butyl phenol), 2,6-di-tertbutyl-4-methyl phenol, 4-hydroxymethyl-2,6-di-tert-butyl phenol, 2,6-di-tert-4-n-butyl phenol, 2,6-bis(2'-hydroxy-3'-tert-butyl-5'-methyl benzyl)-4-methyl phenol, 4,4'-methylene-bis-(6-tert-butyl-o-cresol), 4,4'-butylidene-bis(6-tert-butyl-m-cresol), 3.9-bis{1.1-dimethyl-2-[β-(3-t-butyl-4-hydroxy-5-methyl phenyl) propionyloxy] ethyl} 2,4-8,10-tetraoxaspiro[5,5] undecane.

Illustrative commercial antioxidants are given below.

Examples of phenolic anti-oxidants include "SUMILIZER BHT BP-76, WX R, GA-80 and BP-101" (SUMITOMO), "IRGANOX 1076, 565, 1035, 1425 WL, 3114, 1330 and 1010" (Ciba-Geigy), "MARK A0-50, -80, -30, -20, -330 and -60" (ADECA ARGUS), TOMINOX SS, TT" (YOSHITOMI), "IONOX WSP" (ICI), "SANTONOX" (MONSANTO), "ANTAGECRYSTAL" (KAWAGUCHI), "ANTAGE W-400" (KAWAGUCHI), "NOCLIZER NS-6" (OUCHI-SHINKO), "TOPANOL CA" (ICI), and "CYANOX 1790" (ACC).

Examples of phosphorus-based antioxidants include "IRGAFOS 168" (Ciba-Geigy), "WESTON 618" (BORGWARNER), "MARK 2112, PEP-8, PEP-24G, DEP-36" (ADECA ARGUS), "ULTRANOX 626" (BORGWARNER), and HCA (SANKO).

Examples of thioether based antioxidants include "DLTDP" (YOSHITOMI),. "SUMILIZER TPM, TPS, TP-D" (SUMITOMO), "ANTIOX L" (NICHIYU), DMTD "YOSHITOMI" (YOSHITOMI), "ANTIOX M, S" (NICHIYU), DSTP "YOSHITOMI" (YOSHITOMI), "SEENOX 412S" (SIPRO), "MARK AO-412 S, AO-23 , 329K, 260, 522A", (ADECA ARGUS), "SANDSTABP-EPQ" (SAND), "IRGAFOS P-EPQ FF (CIBA-GEIGY), "IRGANOX 1222" (CIBA-GEIGY), and "WESTON 399" (BORGWARNER).

Examples of metal inactivators include "NAUGARD XL-1" (UNI-ROYAL), "MARK CDA-1, and CDA-6" (ADECA ARGUS), "IRGANOX MD-1024" (CIBA-GEIGY) and "CUNOX" (MITSUI TOATSU).

The content of the anti-oxidants relative to the colored packaging material for the photosensitive material is 0.001 to 5 wt %, preferably 0.002 to 4 wt %, more preferably 0.005 to 3 wt % and most preferably 0.01 to 2 wt %. If the content is in the range of 0.001 to 5 wt %, it becomes possible to prevent deterioration of the colored packaging material for the photosensitive material, generation of substances adversely affecting photographic properties of the photosensitive material, such as aldehydes or halogenides, due to thermal decomposition, or generation of fish-eyes or micro-grids. However, if the antioxidants are used in excessive amounts, the photographic properties are deteriorated. Thus it is desirable to add the antioxidants in the smallest possible amount for preventing thermal decomposition of the resin or the additives.

For preventing electric charging possibly producing static marks in the photosensitive material, any of a variety of common anti-static agents, such as monoglyceride stearate or stearyl diethanolamine, may be added in an amount of 0.01 to 5 wt %, preferably in an amount of 0.02 to 4 wt % and more preferably in an amount of 0.05 to 3 wt %.

EXAMPLES

The present invention will be explained with reference to illustrative Examples. The present invention, however, is not limited to these Examples.

Example 1

A colored mono-layer inflated film, as a colored packaging material for the photosensitive material 1 was prepared with the use of the following starting materials, composition and method. For the colored pigment, furnace carbon black was used having a refractive index as measured by the oil immersion method by Larsen of 1.6, an average particle size as measured by the electronic microscope method of 20 mμ, a pH of 7.0, a specific gravity as measured by the method A of ASTM D-153 of 1.9, DBP oil absorption amount as measured by the method A of JIS K 6221 of 80 ml/100 g and a Mohs' hardness of 2. For the dispersing pigment, anastate type titanium dioxide ($TiO_2$) was used, having a refractive index as measured by the oil immersion method by Larsen of 2.52, an average particle size as measured by the electronic microscope method of 160 mμ, specific gravity as measured by the method A of ASTM D-153 of 3.7, a DBP oil absorption amount as measured by the method A of JIS K 6221 of 56 ml/100 g and the Mohs' hardness of 6.

For the resin, an L-LDPE resin, which is an ethylene-octene-1 copolymer resin having an MFR as measured under the condition E of ASTM D-1238, of 2.1 g/10 min and a density as measured according to ASTM D-1505 of 0.920 g/cm$^3$, were used. 36 wt % of the colored pigment and 6 wt % of the dispersing pigment were kneaded together for 20 minutes under an external pressure of $10^7$ dyne for 20 minutes, using a jet mill, for dissociating and dispersing the colored pigment for preparing a kneaded mass. This kneaded mass, 0.1 wt % of tetrakis [methylene-3-(3',5'-di-t-butyl-4-hydroxy phenyl) propionate] methane, as anti-oxidant, 0.2 wt % of erucic amide, as lubricant, and 1 wt % monoglyceride stearate, as anti-static agent, were mixed to 56.7 wt % of L-LDPE resin at 190° C., and the resulting mass was mixed and kneaded for 20 minutes under an external pressure of $10^7$ dyne by a Banbury mixer to form a master batch having a pigment density of 42 wt % (a colored pigment cencentration of 36 wt % and a dispersing pigment concentration of 6 wt %). Then, 90 wt % of the same L-LDPE resin for dilution as that described above were added to 10 wt % of the master batch and mixed thoroughly. Then, by the inflation film molding method, a colored packaging material for the photosensitive material of a mono-layer light-shielding packaging film, having a thickness of 20 $\mu$m and a pigment cencentration of 4.2 wt %, was molded. The light transmittance and the state of generation of micro-grids were checked of the colored packaging material for the photosensitive material. Also, a negative photographic film having an ISO sensitivity of 100 was packaged into this colored packaging material for the photosensitive material and sealed by a hot-plate bonding method to form a photosensitive material tightly packaged in the form of a light-shielding bag (envelp). The light transmittance was measured from a haze value as measured by the ASTM D-1003. The generation of micro-grids was checked visually. The light-shielding properties were judged based on the degree of light fog after developing the negative photographic film as the packaged photosensitive material. The light-shielding properties were evaluated based on the degree of light fog after developing the photographic negative film in the packaged photosensitive material following light exposure of the packaged photosensitive material to a sunbeam of 80,000 lux for two hours. The results are shown in Table 1.

TABLE 1

| Example No. | Light Transmittance (%) | Light-Shielding Performance | Generation of Micro-Grids |
|---|---|---|---|
| Example 1 | 0 | ○ | ◎ |
| Example 2 | 0 | ○ | ◎ |
| Example 3 | 0 | ○ | ◎ |
| Example 4 | 0 | ◎ | ◎ |
| Example 5 | 0 | ◎ | ◎ |
| Comp. Ex. 1 | 0.8 | Δ | Δ |
| Comp. Ex. 2 | 1.2 | x | • |
| Comp. Ex. 3 | 1.8 | x | • |

Evaluation Standard
◎: excellent
○: good
•: acceptable
Δ: objectionable and in need of improvement
x: very objectionable and practically unacceptable Example 2

A colored packaging material for the photosensitive material and a packaged photosensitive material were prepared using the same materials, composition and method as those in Example 1 except substituting a low-density polyethylene, referred to hereinafter as LDPE resin (the resin having an MFR as measured under the condition E of ASTM D-1238 of 2.7 g/10 minutes and a density as measured under ASTM D-1505 of 0.923 g/cm$^3$) for the L-LDPE resin used in Example 1, and scrutinized in the same way and under the same conditions as those of Example 1. The results are shown in Table 1.

Example 3

A colored packaging material for the photosensitive material and a packaged photosensitive material were prepared using the same materials, composition and method as those in Example 1 except substituting acetylene carbon black having a refractive index as measured by the oil immersion method by Larsen of 1.6, an average particle size as measured by the electronic microscope method of 42 m$\mu$, a pH of 6.5, a specific gravity as measured by the method A of ASTM D-153 of 1.9, a DBP oil absorption amount of 115 ml/100 g as measured by the method A of JIS K-6221 and a Mohs' hardness of 2, for the colored pigment in Example 1, and scrutinized in the same way and under the same conditions as those of Example 1. The results are shown in Table 1.

Example 4

A colored packaging material for the photosensitive material and a packaged photosensitive material were prepared using the same materials, composition and method as those in Example 1 except substituting black iron oxide ($Fe_3O_4$) having a refractive index as measured by the oil immersion method by Larsen of 2.55, an average particle size as measured by the electronic microscope method of 170 m$\mu$, a specific gravity as measured by the method A of ASTM D-153 of 4.7, a DBP oil absorption amount as measured by the method A of JIS K 6221 of 40 ml/100 g and a Mohs' hardness of 6, for the dispersing pigment in Example 1, and scrutinized in the same way and under the same conditions as those of Example 1. The results are shown in Table 1.

Example 5

The sorts and the amounts of the colored pigment, dispersing pigment, anti-oxidant, lubricant and the anti-oxidant were the same as those of Example 1. Calcium stearate was used as a surface coating agent for the colored pigment and the dispersing agent. 5 wt % of calcium stearate were divided into two equal portions of 2.5 wt % each and one of the portions was added to the colored pigment and used for coating the colored pigment, while the other was added to the dispersing pigment and used for coating the dispersing pigment. The coated colored pigment and the coated dispersing pigment were mixed for 20 minutes, under an external force of $10^7$ dynes, using a jet mixer, for mixing and dispersion, to prepare a master batch with a pigment concentration of 42 wt % (a colored pigment concentration of 36 wt % and a dispersing pigment concentration of 6 wt %). Then, 90 wt % of the same L-LDPE resin for dilution as that described above was added at 190° C. to 10 wt % of the master batch and mixed thoroughly. The subsequent steps were the same as those of Example 1, and the same scrutiny under the same conditions was made as in Example 1. The results are shown in Table 1.

Comparative Example 1

A colored packaging material for the photosensitive material and a packaged photosensitive material were prepared using the same materials, composition and method as those in Example 1 except providing the colored monolayer packaging material for the photosensitive material having a thickness of 20 $\mu$m and a colored pigment concentration of 4.2 wt % without adding the dispersing pigment of Example 1, and scrutinized in the same way and under the same condition as in Example 1. The results are shown in Table 1.

Comparative Example 2

A colored packaging material for the photosensitive material and a packaged photosensitive material were prepared using the same materials, composition and method as those in Example 2 except providing the colored monolayer packaging material for the photosensitive material having a thickness of 20 μm and a colored pigment concentration of 4.2 wt % without adding the dispersing pigment of Example 2, and scrutinized in the same way and under the same condition as in Example 2. The results are shown in Table 1.

Comparative Example 3

A colored packaging material for the photosensitive material and a packaged photosensitive material were prepared using the same materials, composition and method as those in Example 2 except providing the colored monolayer packaging material for the photosensitive material having a thickness of 20 μm and a colored pigment concentration of 6 wt % without adding the colored pigment of Example 2, and scrutinized in the same way and under the same condition as in Example 2. The results are shown in Table 1.

It is seen from Table 1 that the Examples 1 to 5 are superior in the light shielding properties, with the light transmittance of 0 %, while being superior in generation of micro-grids. It is also seen that Example 4 employing black iron oxide of the black pigments as the dispersing pigment and Example 5 employing the coating of the colored pigment and the dispersing pigment with fatty acid metal salt are most superior in the light-shielding properties. On the other hand, it may be confirmed that the Comparative Examples 1 to 3 are questionable in the light-shielding properties of the packaged photosensitive material and susceptible to noticeable generation of micro-grids due to difficulties in achieving uniform dispersion of the colored pigment.

Preferred modes of carrying out the present invention will be given below. The present invention, however, is not limited to these illustrative modes.

In the colored packaging material for the photosensitive material, containing the colored pigment and the dispersing pigment, the colored pigment is preferably carbon black.

In the colored packaging material for the photosensitive material, containing the colored pigment and the dispersing pigment, the dispersing pigment is preferably black iron oxide ($Fe_3O_4$) and/or titanium dioxide ($TiO_2$).

In the colored packaging material for the photosensitive material, containing the colored pigment and the dispersing pigment, the content of the colored pigment is in any amount of 0.01 to 50 wt %, while the content of the dispersing pigment is in any amount of 0.01 to 30 wt %.

In the colored packaging material for the photosensitive material, containing the colored pigment and the dispersing pigment, the surface of the colored pigment and/or the dispersing pigment is preferably coated with a surface coating.

Illustrative examples of the photosensitive materials are given as follows, not in a limiting way: silver halide photosensitive materials (various monochromatic photographic films, various monochromatic printing papers, various color photographic films, various lithographic films, instant photographic films, motion picture films, and micro-films etc.), thermally developable photosensitive materials (silver halide photosensitive materials, full color thermosensitive paper and fixing type thermo-sensitive paper employing diazo dyes), diazonium photographic photosensitive materials, photopolymer films, azide or diazide-based photographic photosensitive materials, quinone diazide-based photographic photosensitive materials, PS plate, photographic prints and other photographic processing chemicals sensitized or otherwise deteriorated in quality by light (developing solutions and fixing solutions).

Effect of the Invention

Accordingly, the present invention provides following meritorious effects.

By kneading the colored pigment and the dispersing pigment for dissociating and dispersing the colored pigment, the colored pigment is improved in uniform dispersibility, as a result of which the colored packaging material for the photosensitive material having high uniform coloration density, that is having superior light-shielding properties, can be obtained easily. Moreover, since the colored packaging material for the photosensitive material having pre-set light-shielding properties is obtained easily even if the colored pigment in the colored packaging material is lowered in concentration, as a result of which the colored packaging material for the photosensitive material may be improved in physical properties. That is, while the conventional practice is to raise the concentration of the colored pigment because of difficulties involved in dispersing the colored pigment in the packaging material for the photosensitive material, it is now possible to produce a colored packaging material for the photosensitive material improved in light-shielding properties and in physical properties simply by kneading the colored pigment and the dispersing pigment together for improving uniform dispersion of the colored pigment. Since the content of the colored pigment is decreased by not less than 30 wt % of that in the conventional practice for realizing the same light-shielding properties, the packaging material for the photosensitive material is improved in physical properties by not less than 20 %, while being less susceptible to micro-grids and pin-holes and hence excellent in appearance and in photographic properties, as a result of which the production cost is also lowered. Such effect is most outstanding if the Mohs' hardness of the dispersing pigment is 1.5 times or more of that of the dispersing pigment. In addition, the colored packaging material for the photosensitive material is obtainable by the producing method of the present invention. Also, by employing the colored packaging material for the photosensitive material of the present invention, a packaging material for the photosensitive material becomes less susceptible to micro-grids, while the photosensitive material is less susceptible to grazing or fogging due to friction, thus allowing to provide a packaging material for the photosensitive material superior in light-shielding and physical properties.

Furthermore, with the above-described modes of carrying out the present invention, the following meritorious effect may be produced. That is, the light-shielding properties are improved further even if the content of the carbon black is reduced by 14%, while the amount of micro-grids is also reduced.

Further advantages will be apparent in the entire disclosue.

What is claimed is:

1. A colored packaging material for a photosensitive material comprising a colored pigment, a dispersing pigment, and a fatty acid metal salt, wherein said dispersing pigment is a pigment dispersing said colored pigment, and wherein said fatty acid metal salt is present in an amount of from 2 to 5 wt %.

2. The colored packaging material as defined in claim 1 wherein said dispersing pigment has a Mohs' hardness of not less than 1.5 times that of the colored pigment.

3. The colored packaging material as defined in claim 2 wherein said dispersing pigment comprises at least one of white pigment and black pigment.

4. The colored packaging material as defined in claim 2 wherein said dispersing pigment comprises black iron oxide.

5. The colored packaging material as defined in claim 2 wherein said dispersing pigment comprises at least one member selected from the group consisting of black iron oxide, titanium dioxide, dolomite, lithopone pigment, calcium carbonate, alumina, magnesite, and zinc oxide.

6. The colored packaging material as defined in claim 2 wherein said dispersing pigment has a refractive index of at least 1.5.

7. The colored packaging material as defined in claim 1 wherein the colored pigment and/or the dispersing pigment is coated with a coating comprising a fatty acid metal salt.

8. The colored packaging material as defined in claim 7 wherein said fatty acid metal salt is a compound of a fatty acid having 6 to 50 carbon atoms and a metal selected from the group consisting of calcium, zinc, cobalt, manganese, tin, lead, aluminum, magnesium, sodium, barium and cadmium.

9. The colored packaging material as defined in claim 1 wherein said colored pigment comprises carbon black having a DBP oil absorption amount of 10 to 350 ml/100 g and containing cyan compounds in an amount of not more than 0.01 wt %.

10. The colored packaging material as defined in claim 1 wherein said dispersing pigment comprises black iron oxide and/or titanium dioxide.

11. The colored packaging material as defined in claim 1 wherein said colored pigment is present in an amount of 0.01 to 50 wt % and said dispersing pigment is present in an amount of 0.01 to 30 wt %.

12. The colored packaging material as defined in claim 1 wherein at least one of said colored pigment and dispersing pigment is coated with a surface coating agent.

13. The colored packaging material as defined in claim 1 wherein said colored pigment is present by at least 1.5 times in amount of the dispersing pigment.

14. The colored packaging material as defined in claim 1 wherein said dispersing pigment has a Mohs' hardness of at least 3 times of that the colored pigment.

15. The colored packaging material which is a film product of a single- or a multi-layer structure comprising at least one layer of said colored packaging material as defined in claim 1.

16. The colored packaging material as defined in claim 1 wherein said material comprises a homopolyethylene resin produced by polymerization using a metallocene polymerization catalyst having a melt flow rate of 0.1 to 80 g/10 minutes, a density of 0.900 to 0.930 g/cm$^3$ and a molecular weight distribution in terms of Mw/Mn ratio of 1.5 to 15, and/or an ethylene copolymer resin.

17. The colored packaging material as defined in claim 1 wherein said material comprises a homopolyethylene resin produced by polymerization using a metallocene polymerization catalyst having a melt flow rate of 0.001 to 80 g/10 minutes, a density of 0.941 to 0.985 g/cm$^3$ and a molecular weight distribution in terms of Mw/Mn ratio of 1.5 to 15, and/or an ethylene copolymer resin.

18. The colored packaging material as defined in claim 1 wherein said colored pigment comprises carbon black having a sulfur content of not more than 0.6 wt % and is present in a content of 0.05 to 45 wt % in said colored packaging material.

19. The colored packaging material as defined in claim 18 wherein said dispersing pigment comprises at least one member selected from the group consisting of titanium dioxide, zinc sulfide, zinc oxide, barium sulfate, white lead, lithopone pigment, alumina, magnesite, calcium carbonate, talc, magnesium silicate, calcium sulfate, dolomite, mica, aluminum hydroxide, silica, black iron oxide, and brown iron oxide and is present in a content of 0.01 to 30 wt % in said colored packaging material.

20. A method for producing a colored packaging material for a photosensitive material comprising a colored pigment, a dispersing pigment, and a fatty acid metal salt, wherein said dispersing pigment is a pigment dispersing said colored pigment, the method comprising:

providing a resin, colored pigment, a dispersing pigment, and a fatty acid metal salt, wherein said fatty acid metal salt is present in an amount of from 2 to 5 wt %, and mixing and/or kneading said colored pigment and said dispersing pigment with said resin, to dissociate and disperse said colored pigment into said resin.

21. The method as defined in claim 20 wherein said dispersing pigment has a Mohs' hardness of not less than 1.5 times that of the colored pigment.

22. A packaged photosensitive material which comprises a photosensitive material packaged by a colored packaging material for a photosensitive material comprising a colored pigment, a dispersing pigment, and a fatty acid metal salt, wherein said dispersing pigment is a pigment dispersing said colored pigment, and wherein said fatty acid metal salt is present in an amount of from 2 to 5 wt %.

23. The packaged photosensitive material as defined in claim 22 which comprises a photographic film contained in a patrone or cartridge.

24. The packaged photosensitive material as defined in claim 22 which comprises a photographic film contained in a case formed of said colored packaging material, said case having a lens.

* * * * *